United States Patent [19]

Southard

[11] 3,955,460

[45] May 11, 1976

[54] ELECTRONIC MUSICAL INSTRUMENT EMPLOYING DIGITAL MULTIPLEXED SIGNALS

[75] Inventor: James S. Southard, Union, Mich.

[73] Assignee: C. G. Conn Ltd., Elkhart, Ind.

[22] Filed: Mar. 26, 1975

[21] Appl. No.: 561,970

[52] U.S. Cl. ..... 84/1.17; 84/115; 340/365 S

[51] Int. Cl.[2] ..... G10H 1/02; G10H 5/00

[58] Field of Search ..... 84/1.01, 1.03, 115, 84/1.17; 340/365 R, 365 S

[56] References Cited

UNITED STATES PATENTS

| | | | |
|---|---|---|---|
| 3,297,812 | 1/1967 | Cordry | 84/1.01 |
| 3,610,799 | 10/1971 | Watson | 84/1.01 |
| 3,610,800 | 10/1971 | Deutsch | 84/1.01 |
| 3,614,287 | 10/1971 | Klann | 84/1.01 |
| 3,696,201 | 10/1972 | Arsem et al. | 84/1.01 |
| 3,697,661 | 10/1972 | Deutsch | 84/1.01 |
| 3,743,755 | 7/1973 | Watson | 84/1.01 |
| 3,746,773 | 7/1973 | Uetrecht | 84/1.01 |
| 3,871,247 | 3/1975 | Bonham | 84/1.01 X |
| 3,875,842 | 4/1975 | Kmetz | 84/1.01 |
| 3,899,951 | 8/1975 | Griffith et al. | 84/1.01 |
| 3,902,395 | 9/1975 | Avant | 84/1.01 X |
| 3,902,397 | 9/1975 | Morez et al. | 84/1.01 X |

*Primary Examiner*—L. T. Hix
*Assistant Examiner*—Stanley J. Witkowski
*Attorney, Agent, or Firm*—LaValle D. Ptak

[57] ABSTRACT

An electronic musical instrument, such as an organ, includes a multiplexing system for simultaneously scanning key switches on all of the manual keyboards and pedalboards sequentially an octave at a time and further for simultaneously and sequentially scanning all coupler controls to produce a digital output signal having pre-assigned positions for each of the different notes represented by operation of a coupler switch or a key switch in all of the coupler control sections and the keyboard sections of the organ. This digital signal is supplied to de-multiplexer keyer circuits for reproducing sound signals supplied to the output loudspeakers of the organ. The digital signal is sampled simultaneously in de-multiplexer/keyer circuits (for flute, chiff, celeste, swell string, great string) once each cycle thereof by a strobe pulse which is displayed by differing amounts prior to its application to different ones of the keyers to compensate for the different numbers and range of tones reproduced by the keyer circuits. This is done to correlate and align the tones reproduced by the different keyer circuits for producing the composite of tones supplied to the loudspeakers.

17 Claims, 17 Drawing Figures

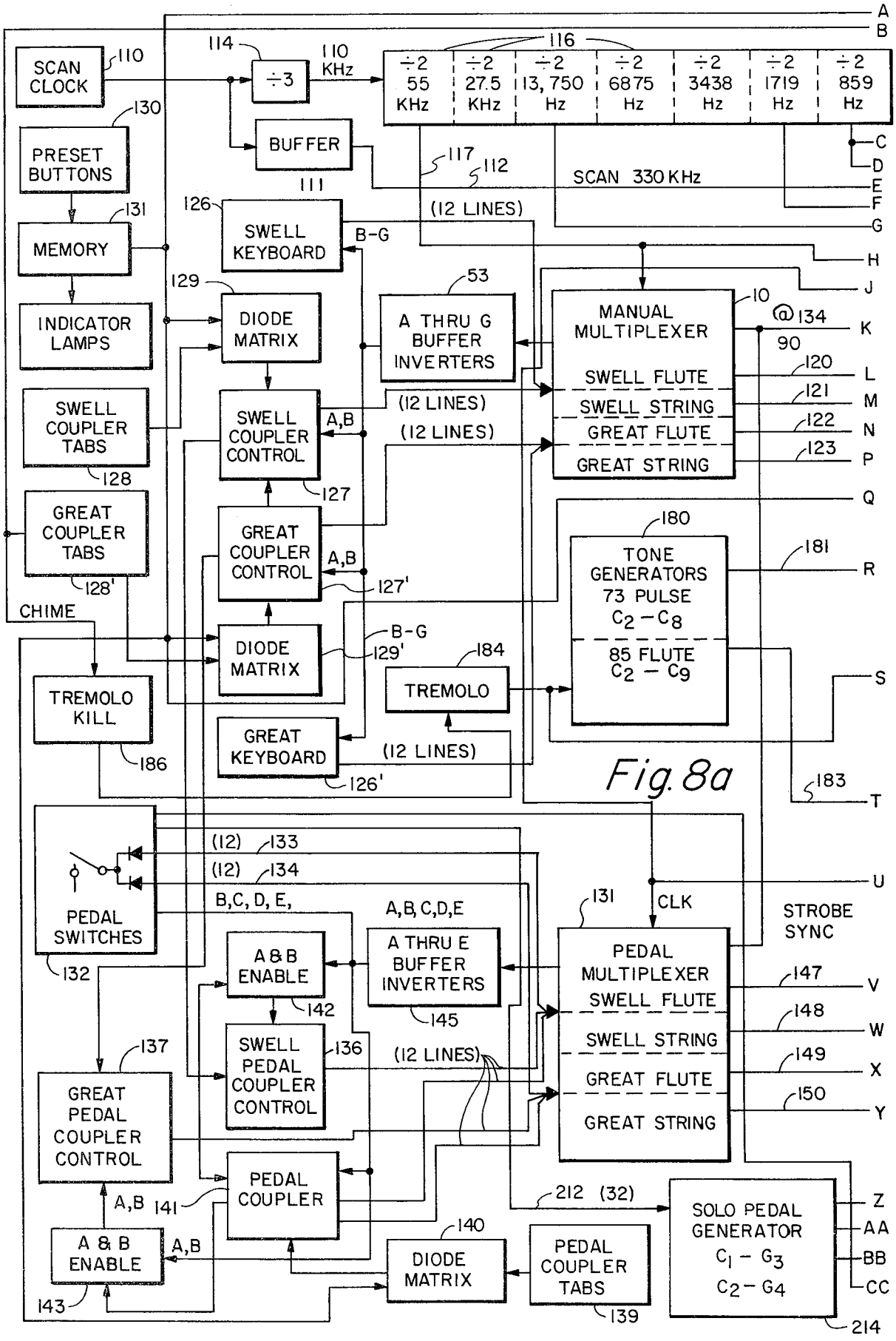
SCAN CLOCK
110
114
÷3
110 KHz
116
÷2 55 KHz
÷2 27.5 KHz
÷2 13,750 Hz
÷2 6875 Hz
÷2 3438 Hz
÷2 1719 Hz
÷2 859 Hz
PRESET BUTTONS
130
BUFFER
111
117
112
SCAN 330 KHz
MEMORY
131
126
SWELL KEYBOARD
B-G
(12 LINES)
INDICATOR LAMPS
129
DIODE MATRIX
53
A THRU G BUFFER INVERTERS
MANUAL MULTIPLEXER
10
@134
90
SWELL FLUTE
SWELL STRING
GREAT FLUTE
GREAT STRING
120
121
122
123
SWELL COUPLER TABS
128
SWELL COUPLER CONTROL
A,B
127
GREAT COUPLER TABS
128'
GREAT COUPLER CONTROL
127'
180
TONE GENERATORS 73 PULSE C2 – C8
85 FLUTE C2 – C9
181
CHIME
DIODE MATRIX
129'
184
TREMOLO
TREMOLO KILL
186
GREAT KEYBOARD
126'
Fig. 8a
183
PEDAL SWITCHES
132
(12) 133
(12) 134
B,C, D, E,
A,B, C,D,E
131
CLK
STROBE SYNC
A & B ENABLE
142
A THRU E BUFFER INVERTERS
145
PEDAL MULTIPLEXER
SWELL FLUTE
SWELL STRING
GREAT FLUTE
GREAT STRING
147
148
149
150
137
SWELL PEDAL COUPLER CONTROL
136
GREAT PEDAL COUPLER CONTROL
PEDAL COUPLER
141
212 (32)
SOLO PEDAL GENERATOR C1 – G3 C2 – G4
214
A,B
A & B ENABLE
143
140
DIODE MATRIX
PEDAL COUPLER TABS
139
A
B
C
D
E
F
G
H
J
K
L
M
N
P
Q
R
S
T
U
V
W
X
Y
Z
AA
BB
CC

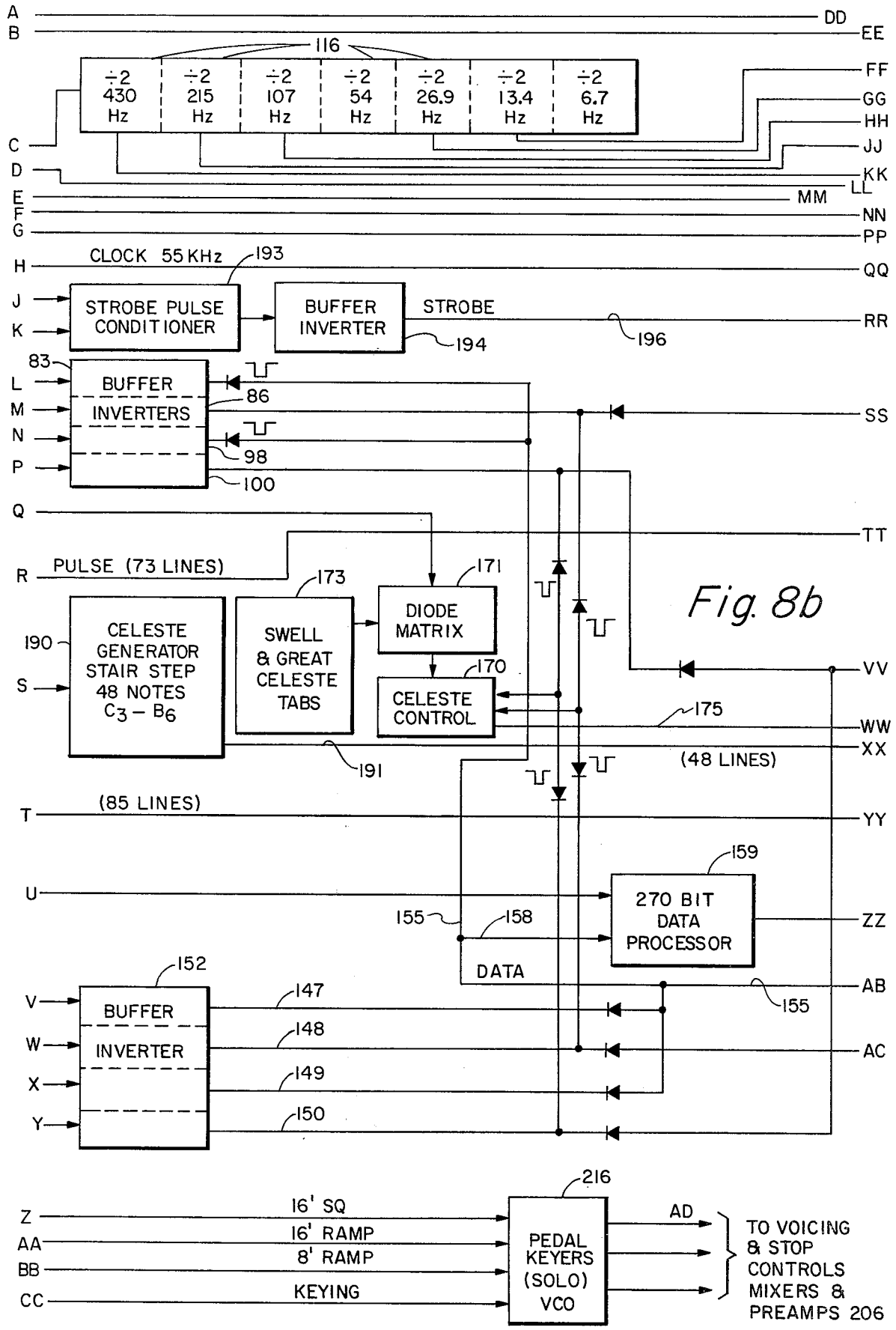
A
B
DD
EE
116
÷2 430 Hz
÷2 215 Hz
÷2 107 Hz
÷2 54 Hz
÷2 26.9 Hz
÷2 13.4 Hz
÷2 6.7 Hz
FF
GG
HH
JJ
KK
LL
MM
NN
PP
C
D
E
F
G
H
CLOCK 55 KHz
193
QQ
J
K
STROBE PULSE CONDITIONER
BUFFER INVERTER
STROBE
RR
194
196
83
L
M
N
P
BUFFER INVERTERS
86
98
100
SS
Q
TT
R
PULSE (73 LINES)
173
171
DIODE MATRIX
Fig. 8b
190
S
CELESTE GENERATOR STAIR STEP 48 NOTES C3 – B6
SWELL & GREAT CELESTE TABS
170
CELESTE CONTROL
175
VV
WW
XX
191
(48 LINES)
T
(85 LINES)
YY
159
U
270 BIT DATA PROCESSOR
155
158
ZZ
DATA
AB
155
152
V
W
X
Y
BUFFER INVERTER
147
148
149
150
AC
216
Z
AA
BB
CC
16' SQ
16' RAMP
8' RAMP
KEYING
PEDAL KEYERS (SOLO) VCO
AD
TO VOICING & STOP CONTROLS MIXERS & PREAMPS 206

ELECTRONIC MUSICAL INSTRUMENT EMPLOYING DIGITAL MULTIPLEXED SIGNALS

BACKGROUND OF THE INVENTION

This invention is broadly related to the field of electronic musical instruments, particularly electronic organs or other electronic musical instruments having a keyboard such as electric pianos, accordians and the like. The term "organ" as used throughout the specification and claims in intended in a generic sense to include these other electronic musical instruments. In addition, reference to the actuation of key switches or coupler switches and the like is intended to cover the actuation of such switches by whatever means may be employed, such as directly by action of the musician's fingers or indirectly through intervening levers, apertures, switch closings, touch responsive switches, etc.

In the design of electronic organs, an attempt is made to faithfully reproduce as nearly as possible the musical sounds and tones which are developed by true pipe organs in response to the playing of the electronic organ by a musician. In order to simulate as many pipe organ sounds as possible, electronic organs have included a large number of switches, wiring cables, and the like, to permit the utilization of intramanual and intermanual couplers employed with at least two manual keyboards and a single pedalboard. A pair of pedalboards and an even larger number of manual keyboards are used in more complex electronic organs. The manual keyboards generally encompass several octaves and the pedalboards usually one or more octaves. In addition, a typical electronic organ includes a relatively large number of playing stops or tabs which are associated with each of the keyboards to permit selection of different organ voices for the tones produced by those keyboards by changing the timbre, tone quality and the like.

The large number of interconnections between the keyboards, couplers, stops and tone generators for such electronic organs results in substantial complexity and assembly costs. In addition, the maze of cabling and wires and connection points within the organ circuitry increases the possibility of failure and makes servicing of the instrument difficult and expensive.

Attempts to reduce the complexity of electronic organs, and in particular to reduce the large amounts of interconnecting wiring and cables and the terminal connections for such interconnecting wiring, has resulted in the development of multiplexing arrangements for replacing much of the wiring hitherto required. One type of digital multiplexing system which has been employed utilizes a scanning system to repetitively scan the switches for each key and coupler position in all of the keyboards and couplers in series to produce a single series train of time-division multiplexed pulses, each of which represents the condition of operation of a particular key or coupler in the instrument. This pulse train can be transmitted on a single wire to a de-multiplexing section of the organ where the pulses are used to operate keyers to produce tones representative of the keys which have been actuated. For an organ with a large number of manual keyboards and pedalboards, this sequential scanning of all of the possible keys and couplers in series results in a very long pulse train for each cycle of operation of the scanning system. The length of each pulse train cycle is directly proportional to the number of notes in an octave times the number of octaves times the number of keyboards and pedalboards used in the organ. This results in a relatively complex de-multiplexing section of the organ, even though such a system results in substantial economies of wiring complexity over electronic organs not employing a multiplexing system.

Another type of multiplexing system, which has been developed in the prior art, employs a separate transmission line between a multiplexing portion and a de-multiplexing portion for each different octave in each of the different keyboards and pedalboards. The twelve notes in each of these octaves are represented by twelve time positioned pulses representing the twelve semi-tones of the corresponding octave. All of the octaves of all of the keyboards and pedalboards of the organ are transmitted simultaneously on the respective octave leads as time-division multiplexed note pulses. For an organ having two manual keyboards, each with a capacity of five octaves, and a pedalboard, this type of system results in eleven transmission lines between the multiplexing portion of the organ and the de-multiplexing portion. In addition, if intramanual and intermanual couplers are provided, a provision must be made for transferring pulses on one of the octave leads to one or more of the others by means of wiring and logic interconnections between the different leads. The result is a relatively large number of wires and wiring interconnections, although not as many as are required for a standard electronic organ which does not employ any multiplexing at all.

It is desirable to provide an electronic musical instrument such as an electronic organ which does not require a large mass of conductors and connection points to provide electrical connections between the keys of each of the keyboards (manual and pedal) and the tone generators of the organ. In addition, it is desirable to employ a system for driving the keyer sections of an electronic organ in parallel from a multiplexed signal train while using different numbers of individual keyers for the different tone qualities, such as flute and string, produced by the organ.

It is also desirable to reduce the number of pulses in the multiplex signal train which are necessary to convey all of the information from all of the keyboards to all of the keyers, while at the same time minimizing the number of lines interconnecting the multiplexer portion of the organ with the de-multiplexer portions.

SUMMARY OF THE INVENTION

It is an object of this invention to provide an improved electronic musical instrument.

It is another object of this invention to provide an improved note selection system utilizing digital multiplexing techniques in an electronic organ.

It is a further object of this invention to provide an improved tone selection system in an electronic organ which minimizes the wiring requirements for the organ.

It is yet another object of this invention to utilize a digital multiplex system in an electronic organ for controlling the operation of tone keyers in accordance with the operation of a plurality of keyboards and intramanual and intermanual couplers.

It is an additional object of this invention to provide an improved time-division multiplex electronic musical instrument.

In accordance with a preferred embodiment of this invention, an electronic musical instrument includes at least two different groups of key switches for each of two different keyboards. The scanning circuit simultaneously scans the key switches in each of these groups repetitively and sequentially to detect actuation of any one or more of the key switches in each of the groups. The output of the scanning circuit is used to provide a composite digital signal comprised of a sequence of pulses representative of respective actuated key switches in both of the first and second groups with the location of the pulses in the digital signal corresponding to particular tones to be reproduced.

In more specific implementations of the system, the digital signal is supplied to different keyer circuits in parallel, and the keyer circuits have different capacities for sound signals which correspond to the keying function they represent, that is flute or string, for example. Because of these different capacities, a provision is made to strobe or read the digital information supplied to the keyers at different times to cause proper alignment of the tones generated by the keyers in the audio reproduction portion of the instrument.

In addition to scanning the keyboards, and in more specific embodiments, the pedalboards of an organ, the scanning circuit also sequentially scans the coupler controls for the various keyboards and pedalboards simultaneously, and this information is combined in a multiplexer circuit with the information obtained from the scanning of the key switches to produce a composite digital signal representative of tones selected by the key switches and selected by intramanual and intermanual controls.

The foregoing and other objects and features of the present invention will be better understood when taken in conjunction with the following description and the drawings, in which like reference numerals indicate like parts throughout the several figures.

BRIEF DESCRIPTION OF THE DRAWINGS

FIGS. 8A, 8B and 8C are a block diagram of a preferred embodiment of the invention;

DETAILED DESCRIPTION

Figure 1:
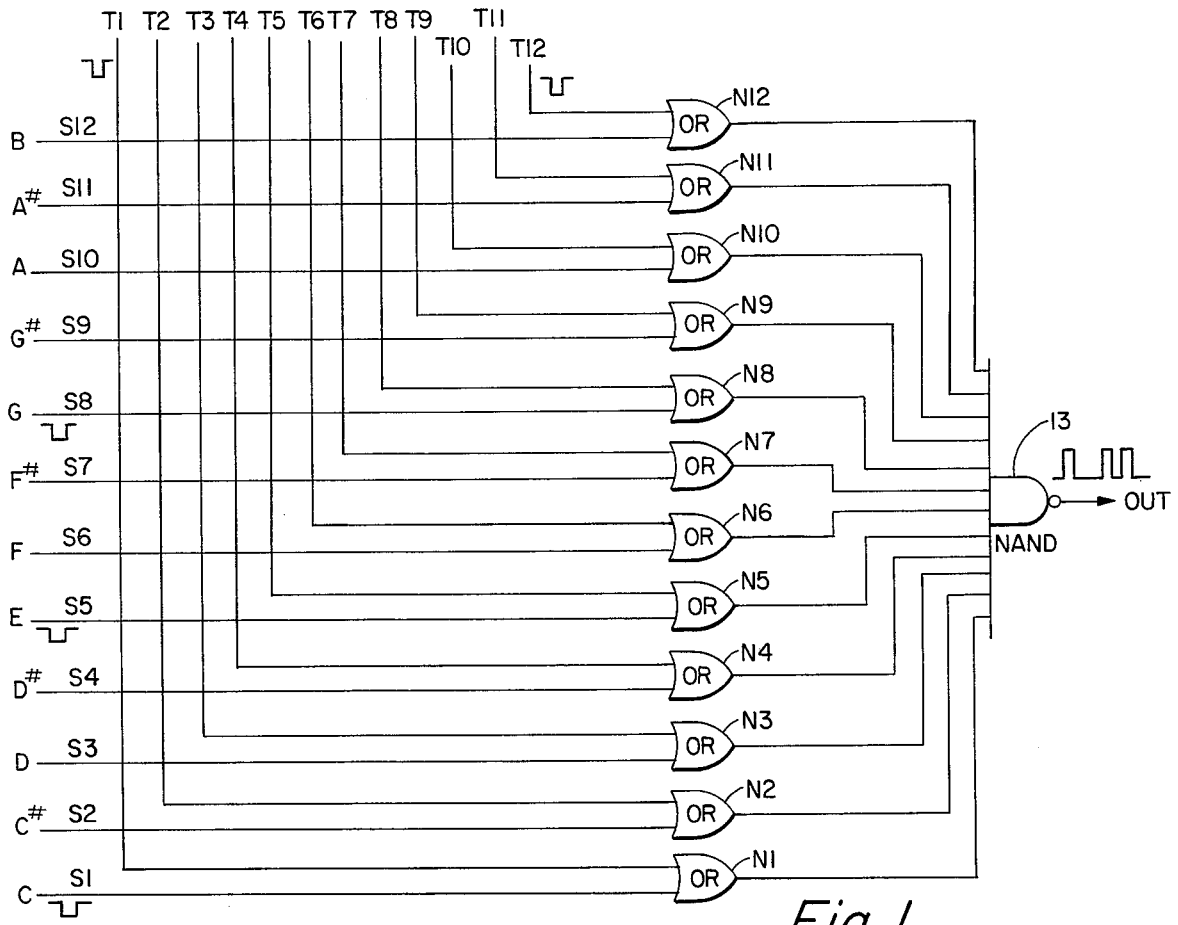
FIG. 1 is a schematic diagram of a portion of a circuit used in producing time-division multiplexed signals for the operation of one embodiment of the present invention.

Referring now to FIG. 1, there is shown a simplified logic diagram of a portion of a circuit for producing a series pulse train representative of different key and coupler switch closings in the form of a time-division multiplexed signal. It is apparent that there are two sets of inputs to the system multiplexer which preferably is in the form of an MOS integrated circuit chip. One of two sets of inputs to the multiplexer is indicated in FIG. 1 as leads S1 through S12, corresponding to an octave of the Swell keyboard. A similar set of inputs also may be used to represent the octave inputs from the Great keyboard. In FIG. 1, only those inputs for the Swell manual keyboard are indicated. The notes of the octaves represented by these inputs are also indicated along the left-hand side of the horizontal leads in FIG. 1. Input S1 corresponds to note C, and the remainder of the inputs correspond to the ascending notes of the octave, with input S12 corresponding to note B within the multiplexer. Each of these inputs are supplied to an input of different corresponding OR gates N1 through N12, respectively. The second set of inputs to the multiplexer is applied to each of the OR gates N1 to N12 from twelve corresponding enabling leads T1 to T12, respectively. Any time a negative pulse appears on one of the enabling leads T1 to T12 for one of the OR gates N1 through N12, simultaneously with the appearance of a negative signal on the key switch input lead S1 to S12 for the same OR gate, the output of that OR gate is negative. For all other combinations of inputs on the two input terminals of the OR gates N1 to N12, the output of the gates are positive.

The outputs of all of the OR gates N1 through N12 are connected to corresponding inputs of an output NAND gate 13 which produces a positive output pulse any time any one of the inputs to it are negative. Different types of coincidence gates could be employed for the gates N1 to N12 and 13 so long as the output result uniquely identifies the condition of the signal on one of the key switch input leads S1 to S12 in time coincidence with the scanning signals on the scanning input leads T1 to T12.

As an illustration of the operation of the circuit of FIG. 1, consider the following example. Assume that a chord is to be played which includes the notes C, E, G in the same octave (the C chord). The operation of the key switches in the keyboard (not shown in FIG. 1) then causes a negative input to appear on the leads S1, S5 and S8, which correspond respectively to the notes C, E and G in the chord. These negative inputs are applied to the lower inputs of the corresponding OR gates N1, N5 and N8. The notes of the octave are sampled in sequence by the application of negative input pulses, one at a time, to the leads T1 through T12 at a rate which determines the frequency of operation of the multiplex system.

When a negative enabling pulse is applied to the lead T1, it appears at the same time that the lower input of the OR gate N1 is negative, which produces a negative output from the gate. The outputs of all of the other OR gates N2 to N12 at this time are positive since at least one of the two inputs to each of these other gates is positive. This negative output applied to the input of the NAND gate 13 causes the output of that gate to be a positive pulse for the time duration of the negative pulse on the lead T1.

Upon termination of the pulse on the lead T1, a negative scanning pulse next appears on the lead T2. However, since no key switch has been operated to produce a negative signal on the lead S2, the lower input to the OR gate N2 is positive; so that the output of the OR gate N2 remains positive. Since the OR gate N2 is the only one to which a negative scanning or enabling pulse is applied at this time, the outputs of all of the other OR gates N1 to N12 are positive. Thus, the output of the NAND gate 13 is negative. This also is true for the enabling pulse as it sequentially is applied to the leads T3 and T4.

When an enabling pulse is applied in the sequence or scan of the leads T1 to T12 to the lead T5, the OR gate N5 is enabled to pass a negative pulse at its output, which in turn again causes the NAND gate 13 to produce a positive pulse during the time interval corresponding to the application of the negative enabling pulse to the scanning input lead T5. As the scan progresses up further through the leads T6 and T7, the output of the NAND gate 13 remains low. Then as the scanning sequence progresses to apply a negative enabling pulse to the lead T8, another bit of information is passed by the OR gate N8 and appears as a positive output pulse at the output of the NAND gate 13. Continuing the sequence for the present example, the output of the NAND gate 13 remains low as the remainder of the octave is scanned by the application of the negative enabling pulses to the input leads T9 through T12.

In this manner, the twelve key inputs for an octave are sequentially sampled and converted into a serial digital word. In the multiplexer system, the sampling sequence is repeated, with a sample of a different octave of keys or coupler switches next being applied to the input leads S1 through S12; so that the output of the NAND gate 13 is a continuous serial data stream, each twelve digital data bits of which are representative of a specific different octave.

Figure 2:
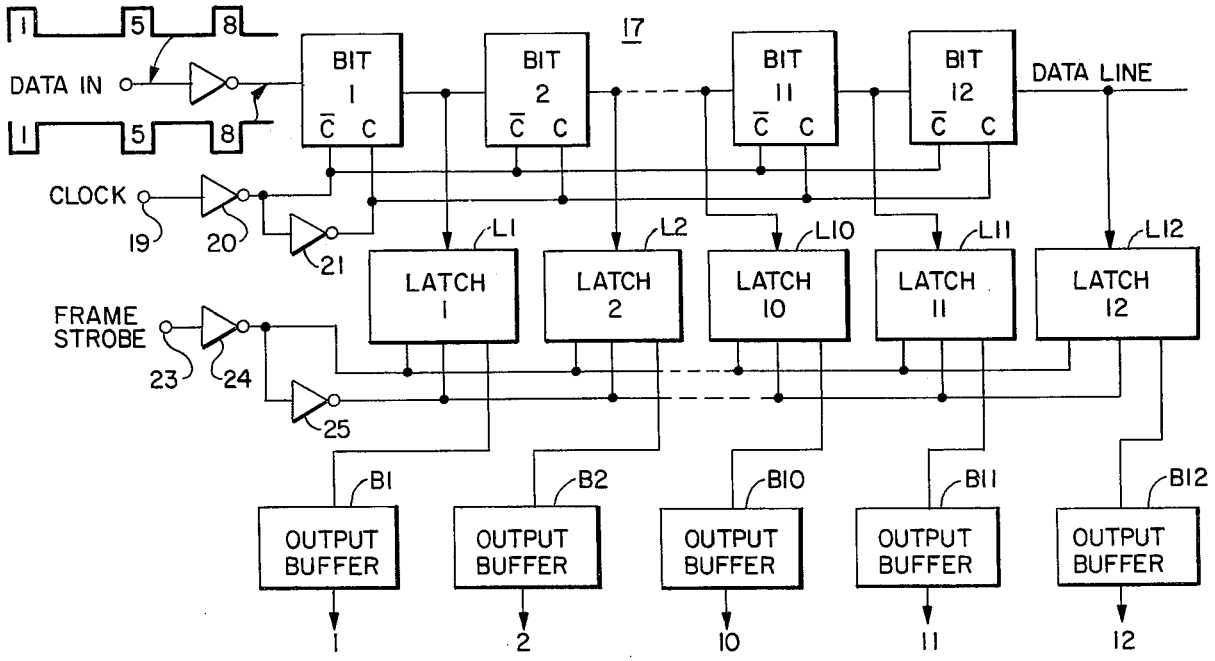
FIG. 2 illustrates a circuit used to convert a serial time-division multiplexed signal into demultiplexed parallel outputs.

Referring now to the FIG. 2, there is shown a simplified block diagram of a de-multiplexing circuit which responds to the digital data produced by the NAND gate 13 to convert it from a serial bit word back into a parallel word. This parallel word then may be utilized to drive the different keyers of the organ to reproduce the tones represented by the digital data bits in the serial signal stream from the output of the NAND gate 13.

The data stream created for the example given above in the description of FIG. 1 is applied to a data input terminal data in (FIG. 2) and is inverted by an inverter 16 and applied to the input of the first stage of a shift register 17. Clock signals for advancing the shift register 17 are applied to a clock input terminal 19 at the same rate and in synchronism with the clock which advances the scan of the leads T1 to T12 in the multiplexer portion of the system of FIG. 1.

The shift register stages are preferably made of integrated circuit MOS transistors and employ a two-phase clock for their operation. To accomplish this, the clock pulses are inverted by a first inverter 20; and the output of this inverter is applied to the C clock input terminal of each of the stages of the register 17. The output of the inverter 20 is inverted a second time by an inverter 21 which supplies opposite phase clock input signals to the clock input C of each of the stages of the shift register 17. The inverted data input applied to the first stage of the shift register 17 then is sequentially shifted through the shift register under the control of the clock pulses applied to the terminal 19 in a conventional manner.

For the simplified one octave version of the system, shown in FIGS. 1 and 2, when the first bit of data has been shifted all the way to the twelfth stage of the shift register 17, the information moving through the register now is in position or lined up in the same octave order as the original key switch information which it appeared on the leads S1 to S12 of the multiplexer shown in FIG. 1. The first data bit appears in the twelfth stage of the shift register 17, and the twelfth data bit for that octave appears in the first stage of the register.

If the clock could be stopped at this time, nothing more would be needed for the de-multiplexing function. The output of each bit of the shift register then could be used to feed some device, such as a keyer or a keyer switch to turn it on to initiate the reproduction of the desired tones. But, since the data signal supplied from the NAND gate 13 is continuous on an octave-by-octave basis, it is necessary to add a sampling or latching circuit to the shift register 17 to sample the data passing through it when that data is properly aligned. To accomplish this, twelve latch circuits L1 through L12 are coupled to the outputs of the corresponding stages of the shift register and respond to store the data appearing in a stage of the shift register 17 whenever a command pulse, called a frame strobe pulse, is applied to a strobe input terminal 23.

The latch circuits L1 through L12 are similar in configuration and operation to the stages of the shift register and, as illustrated, are preferably MOS integrated circuits operating from an opposite phase clock. As a consequence, the frame strobe pulse applied to the terminal 23 is inverted once by a first inverter 24 and applied to one of the two clock inputs of each of the latch circuits L1 to L12. The strobe pulse also is inverted a second time by an inverter 25 and applied to the other opposite-phase clock input of the latch circuits L1 through L12.

Whenever a strobe pulse is applied to the terminal 23, it causes all of the latches L1 through L12 to "look at" the data being applied out of corresponding stages of the shift register 17. If the data appearing at the output of the stage of the shift register 17 to which one of the latch circuits L1 to L12 is connected is different from the data which appeared at that same output at the time the next preceding strobe pulse was applied to the terminal 23, the state of that latch circuit is changed.

For an understanding of the simplified version of the circuit shown in FIG. 2, the frame strobe pulse is applied to the terminal 23 at the end of twelve clock pulses, since for the present example, the system is being considered on the basis of a single octave of information (12 notes). The latch circuits L1 through L12 are bistable multivibrators which store the data present on the output of the corresponding stages of the shift register 17 each time a frame strobe pulse is applied to the lead 23. The outputs of the latch circuits L1 through L12 are supplied through corresponding output buffer amplifier circuits B1 through B12 for application to the keyer circuits in the organ. The information in the latch circuits L1 through L12 is renewed at the end of each octave sampling. Whenever there is a change in one or more notes from one sampling period to the next, this change is reflected at the end of the octave sample when the frame strobe pulse is applied to the terminal 23, at which time the latch circuits L1 to L12 associated with the notes of the octave which changed also changes its state to reflect the change in state of that note.

Figures 3, 4, 9:
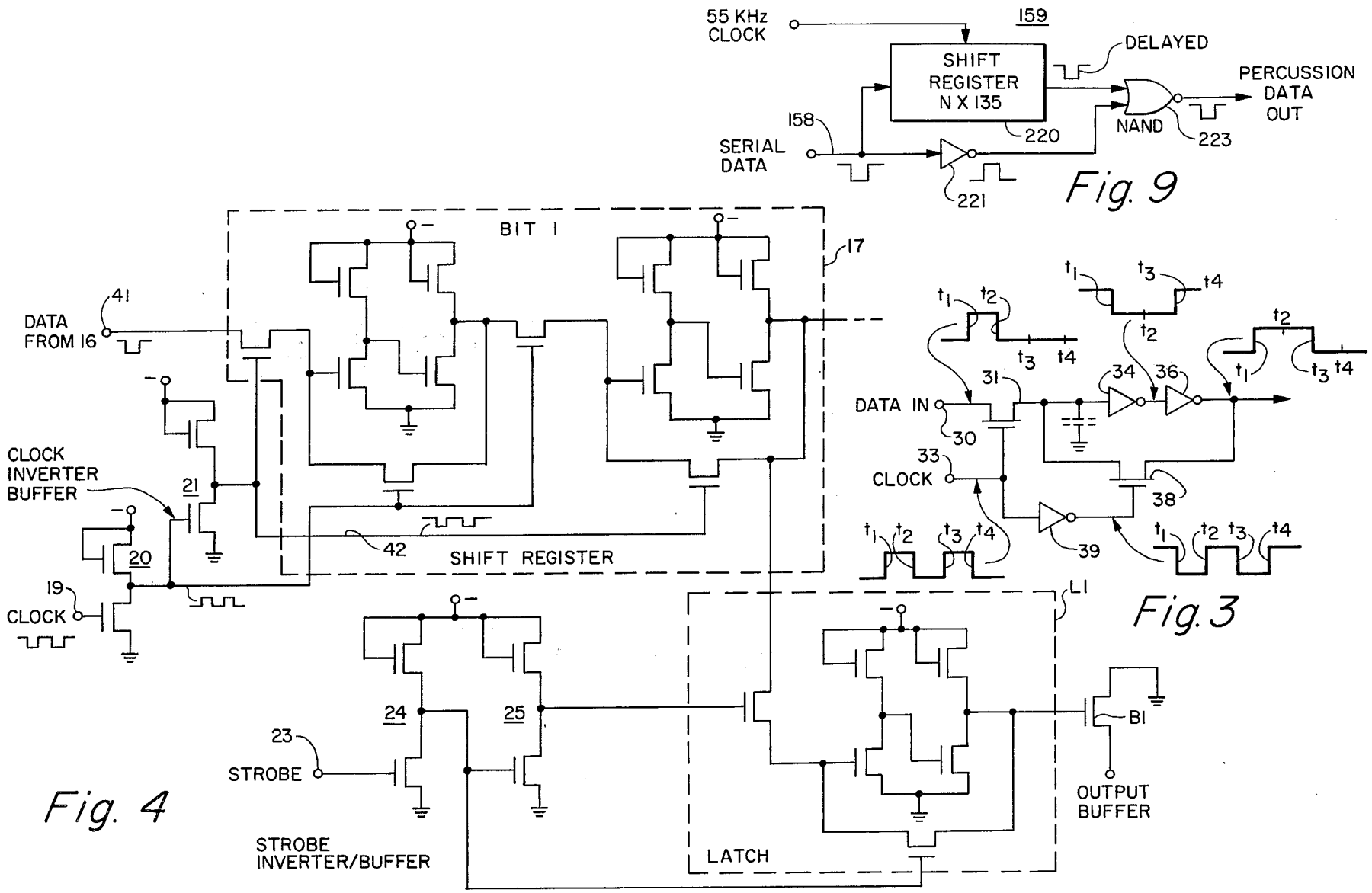
FIG. 3 is a logic circuit diagram of a latching circuit of the type which can be used in the circuit of FIG. 2.
FIG. 4 is a detailed schematic diagram of a portion of the circuit shown in FIG. 2.
FIG. 9 illustrates details of the 270 bit data processor shown in FIG. 8B.

Referring now to FIG. 3, there is shown a schematic logic diagram of a latch circuit which can be used to implement the stages of the shift register 17 or the latch stages L1 to L12 of the circuit of FIG. 2. This is an important circuit in MOS design. The same circuit can be coupled through selective gating in a series connection to produce a shift register. Or it can be used as an interface between an outside load and the shift register as a latch circuit which operates effectively to stop the dynamic running shift register in time to provide a direct current output, even though data is continuously fed into the shift register 17 and clocked through it and out of it.

In the logic diagram of an MOS latch circuit shown in FIG. 3, the negative data input, which is the same as that obtained from the output of the inverter 16 in FIG. 2, is applied to a data input terminal 30 which comprises the input to an FET switch 31. Inverters 34, 36 and 39 are also FET devices. When the FET switch 31 is conductive, data on terminal 30 is allowed to transfer its logic level to the inverter 34, the gate capacitance of which is shown in dotted lines and which retains the logic state momentarily when the FET switch 31 is conductive. The inverter 39 insures that an FET switch 38 is nonconductive when the FET switch 31 is conductive. When the FET switch 38 is conductive, the logic level retained on the gate capacitor is fed back via the inverters 34 and 36, through the FET switch 38, insuring the logic state is retained. The output of the inverter 36 may serve two different purposes. The inverter output can be used as an output point to an outside load circuit, or it can be used as an output point to another latch circuit, such as would be employed in a shift register configuration.

The various pulses shown in FIG. 3 are identified by the different time intervals at which they occur. Note that a positive signal appears on the data input terminal 30 from time T1 to time T2. Also during times T1 to T2, there is a positive input clock which is coupled to the FET switch 31 to allow the positive data applied during period T1 to T2 to be coupled through the switch 31. This data also is inverted by the inverter 34 to produce negative data at the output of the inverter 34 from time interval T1 to T2. The second inverter 36 then inverts the signal back to a positive signal from time T1 to T2. At time T2, the input signal goes low, but the FET switch 38, which was disabled by the negative-going clock pulse applied to the gate during the time period T1 to T2, now is enabled. The switch 38 then passes the positive output of the inverter 36 to the input of the inverter 34 to maintain the output state from time interval T2 to T3.

Referring back again to the data input applied to terminal 30, note that at time T3, in the example given, no positive pulse appears. The clock, however, once again goes positive at time T3. This positive clock enables FET switch 31, but since the input data is negative at this time, the output of FET switch 31 is also negative to couple a negative voltage into the input of the inverter 34. Since the switch 38 once again is disabled at time T3, the output of the inverter 34 is positive; and the output of the inverter 36 at time T3 goes negative. When the clock once again goes negative, the FET switch 38 is enabled. This insures that the inverter 36 output remains low since the FET switch 38 forces the input of the inverter 34 low, the output of the inverter 34 and input of the inverter 36 high.

Referring now to FIG. 4, there is shown a detailed schematic diagram of an MOS implementation of the circuit illustrated in FIG. 3, interconnected to form the shift register stages and the latch stages, shown in FIG. 2, for decoding the multiplexed data. The same reference numbers applied to components shown in FIG. 2 are used in FIG. 4 to facilitate correlation of the detailed circuit of FIG. 4 with the block diagram circuit of FIG. 2.

On the left hand side of FIG. 4, the clock pulse signals are applied to the clock pulse input 19, and the data input signals from the inverter 16 (FIG. 2) are applied to an input terminal 41. The circuit shown in FIG. 4 is illustrated as using PMOS semiconductor technology employing enhancement mode transistors, which are turned on by the application of a negative voltage to the gate region. Thus, all of the data and all of the clocking signals to turn on the transistors are negative-going signals. In other words, a logic "1" or "high" is a negative voltage signal and a logic "0" to "low" is a positive voltage signal.

Clock pulse signals applied to the terminal 19 then are applied to the bottom transistor of the inventer circuit 20 to turn it on for the duration of the clock signals. This bottom transistor normally is off and the top transistor of the inverter circuit 20 normally is on; so that in the absence of the negative-going clock signal, the output junction of the two transistors is normally a negative signal. When the lower transistor of the inverter 20 is turned on, the output junction rises to near ground potential (a positive-going signal). Thus, the circuit 20 inverts the clock signals applied to the terminal 19. These inverted clock signals are applied to the gate of the lower transistor of the second inverter circuit 21, which has the same circuit geometry as the inverter circuit 20. Thus, the second inverter 21 reinverts the clock signal on a lead 42 to cause it to be the same as the clock signal applied to the input terminal 19. These clock signals are applied to different input points in the Bit 1 stage (and the other stages) of the shift register 17 to effect its operation in the manner discussed previously in conjunction with the operation of FIG. 2. The PMOS logic illustrated in FIG. 4 is standard; so that a further detailed explanation of the specific operation of each of the transistors used in the circuit is not considered necessary here.

The operation of the circuit shown in FIG. 4 is in accordance with the operation of the circuits in FIGS. 2 and 3, previously described. The strobe input pulses described in conjunction with FIG. 2 are applied to the terminal 23 and are inverted by a pair of inverters 24 and 25 and which are similar to the inverters 20 and 21 and operate in the same manner. These inverters correspond to the same numbered inverters in FIG. 2 and operate to supply the two-phase clock signals to the corresponding inputs to the latch circuit L1 (and the remaining latch circuits L2 to L12) for storing the data present in each of the stages of the shift register 17 at the time a strobe pulse is applied to the terminal 23.

Figure 5A:
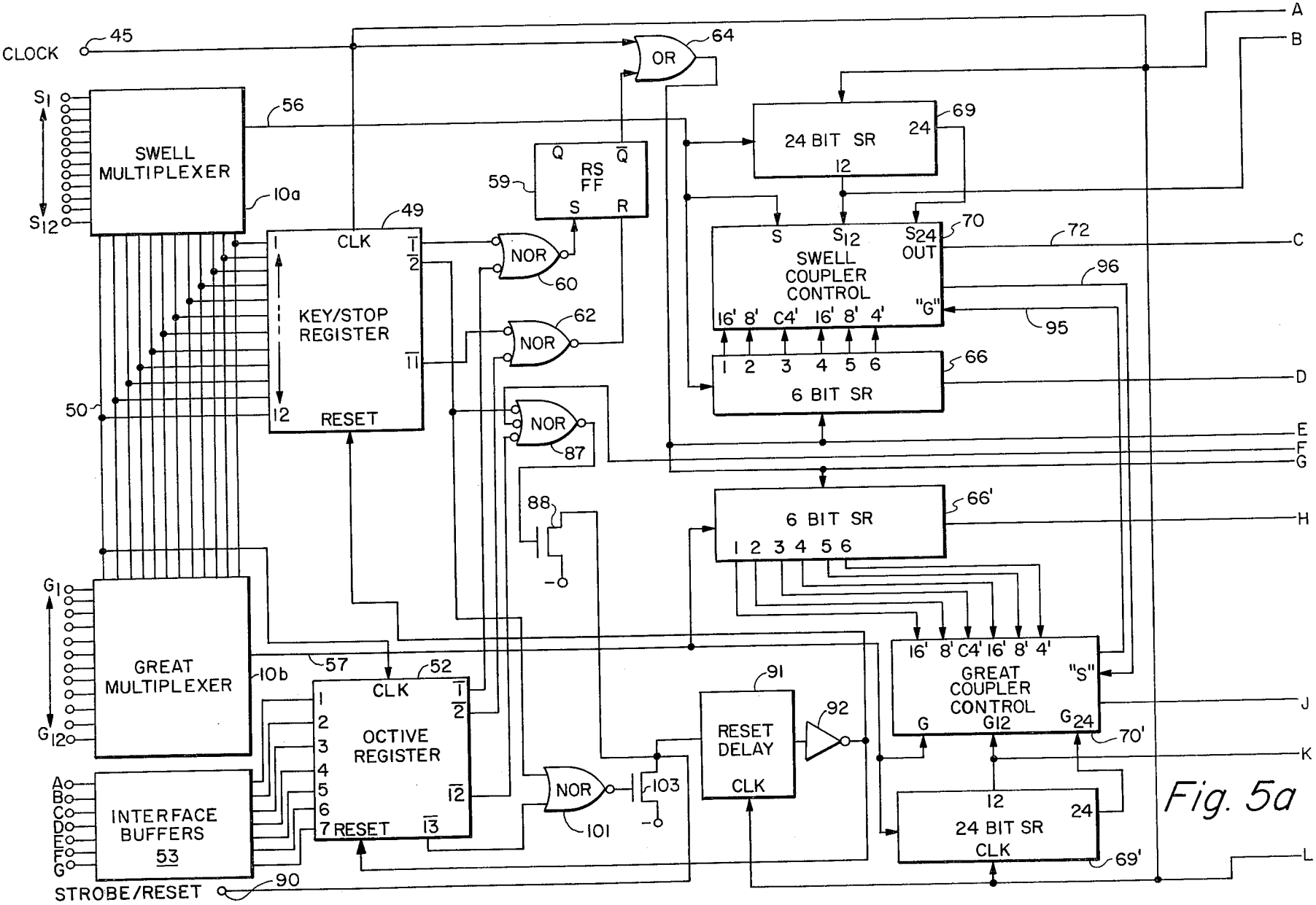
FIGS. 5A and 5B are a detailed block diagram of a portion of a preferred embodiment of the present invention.
Figure 5B:
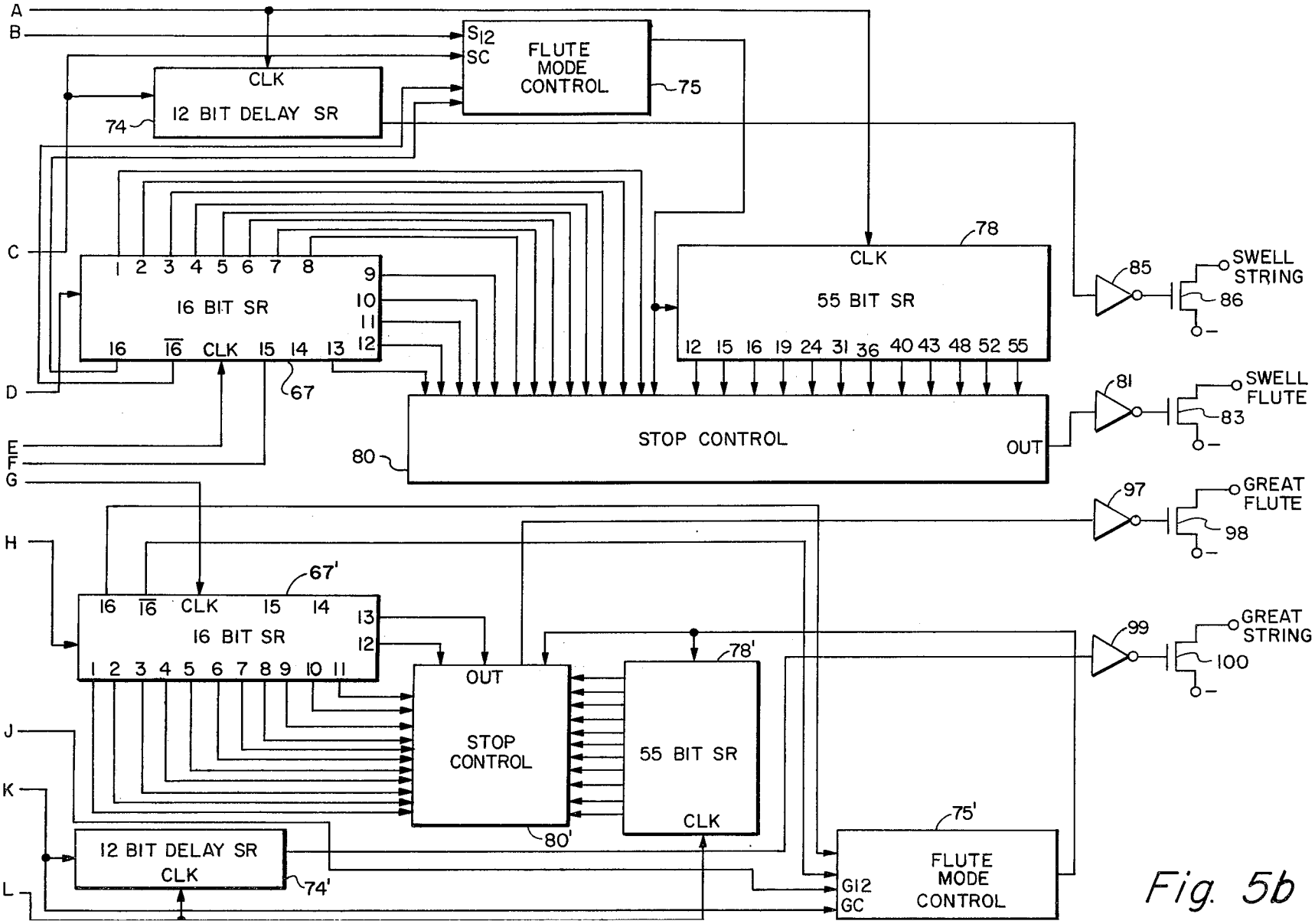

Referring now to FIG. 5A and 5B, which should be placed together edge-to-edge with the right-hand edge of FIG. 5A aligned with the left-hand edge of FIG. 5B, there is shown a block diagram of a more comprehensive multiplexing arrangement in accordance with a preferred embodiment of this invention. The preceding discussion illustrates the manner in which a sequence of octaves of signals are multiplexed into a serial bit word to be sent note-by-note (as represented by the pulses in the word) along a single wire. On the keyboard for a console organ, it is necessary to sample 61 notes(five octaves plus one note) on a single wire.

FIG. 5A shows a clock input terminal 45 in the upper left-hand corner. This clock input terminal has applied to it a sequence of squarewave pulses at 55 kilohertz and having an amplitude of approximately ± 5 volts. These clock input pulses are used throughout the multiplexing and de-multiplexing operation of the system to effect its operation and synchronization.

Immediately beneath the clock input terminal 45 there is shown a section 10*a* of the keyboard multiplexer which is identified as the Swell multiplexer section. This section has twelve inputs S1 through S12 applied to it. These inputs constitute the inputs for an octave of notes, as described in conjunction with FIG. 1, which are selected by the Swell keyboard of the organ. All of the keys of the different octaves for the Cs, Fs and Gs, etc., are tied together on single buses with diode isolation on each key switch. This is illustrated most clearly in FIG. 6 which shows a plurality of such diode switches 47 for both the Swell and Great keyboard and control inputs to the multiplexer 10.

Figure 6:
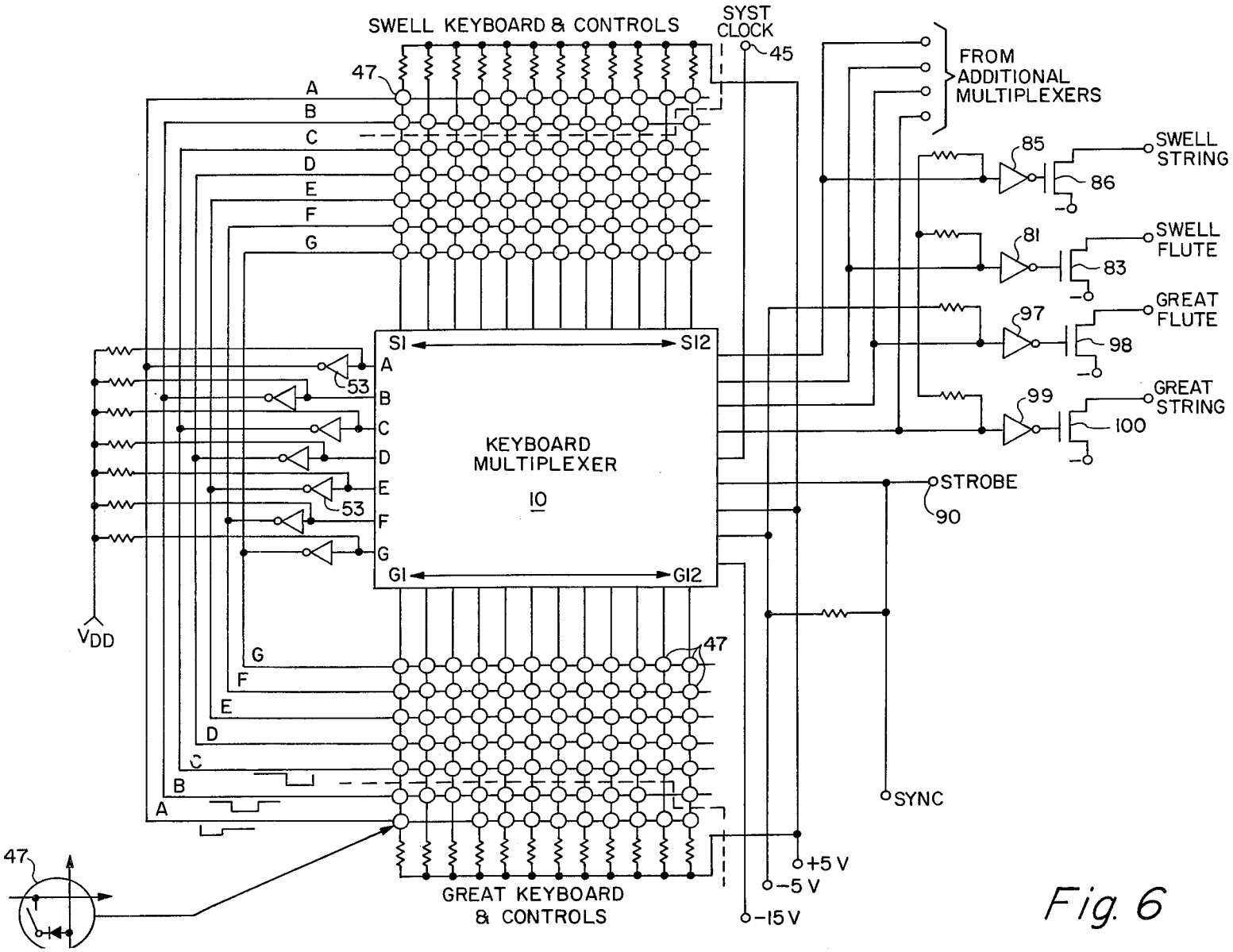
FIG. 6 is a schematic diagram showing utilization of the circuit of FIG. 5.

One of these diode switches is illustrated in the lower left-hand corner of FIG. 6 showing a blown-up illustration of the manner in which the switch operates to interconnect the cross points of the leads S1 through S12 and G1 through G12 with horizontal bus bars A through G applied to the keyboard and control matrix. The utilization of this arrangement of diode isolation key switches permits, for example, the S1 wire coming into the Swell multiplexer section 10*a* to have all of the Cs of the Swell multiplexer wired to it through the isolation diode switches 47.

A key stop register 49 (FIG. 5A) advances through all of its twelve inputs to sequentially sample the signals present on the leads S1 through S12 of the Swell multiplexer and also to simultaneously sample the inputs present on the leads G1 through G12 of the Great multiplexer 10*b*. A clock pulse is taken off the first sample or drive lead 50 and is applied to an octave register circuit 52 to cause it to advance its output to the next octave in the sequence. These outputs of the octave register are labeled 1 through 7, respectively, within the octave register 52 and extend to the left of the register through an interface buffer circuit 53, which sequentially produces drive outputs on the seven output drive lines A through G, respectively. The interface buffer circuits 53 are made of discrete components and are not placed on the integrated circuit multiplexer chip which includes the key stop register 49 and the Swell and Great multiplexer sections 10*a* and 10*b*. The buffers are shown as inverting buffers 53 in FIG. 6 extending to the left of the keyboard multiplexer 10, and they produce the enabling signals for reading the Swell keyboard and control switch closures on an octave-by-octave basis.

For the present time, consider only the output drive lines C, D, E, F and G. These five lines, as most clearly shown in FIG. 6, are tied into a split bus system, each one octave long for each octave of the Swell and Great keyboard manuals. Only one of these leads is enabled at any given time; and it is enabled for twelve time slots, an entire octave, with the octave register being reset to step to the next octave whenever the key stop register 49 steps to pulse lead 50 which scans leads S1 and G1 of the Swell and Great multiplexer sections 10*a* and 10*b*. The key stop register 49 and the octave register 52 can be in the form of counter circuits which can assume a number of different conventional configurations.

Figure 7:
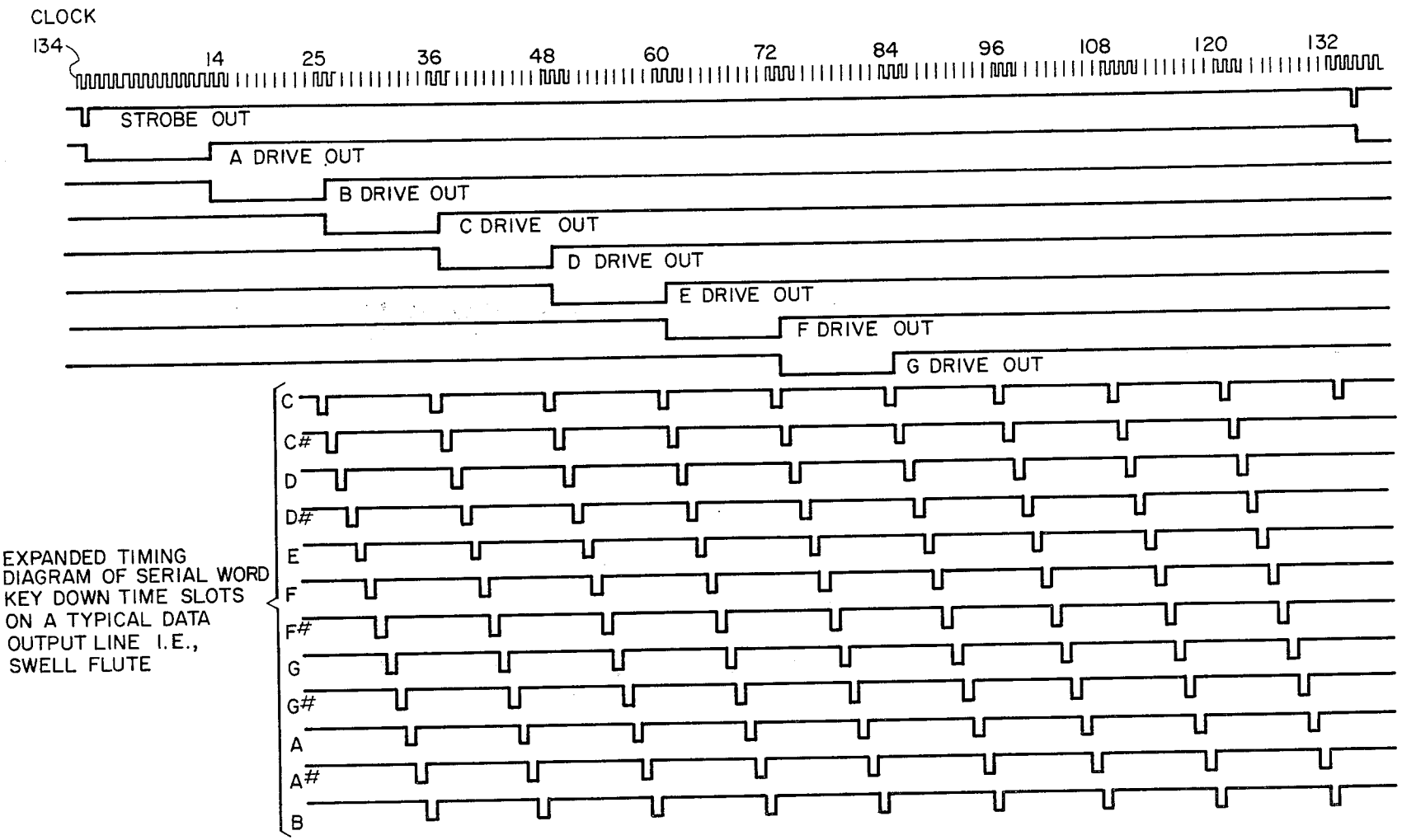
FIG. 7 is a timing diagram useful in explaining operation of the system shown in FIG. 5.

During the time that the drive line C is enabled by a negative pulse, as shown most clearly in FIG. 7, the first octave of both the Swell and Great keyboards are enabled. If a note or chord is played in this octave in either of these keyboards, for example, the C, E, G chord in the first octave of the keyboard, then the negative voltage present on the drive line C enables that particular octave bus, and couples a negative voltage on leads S1, S5 and S8 (or G1, G5 and G8) through the diode switch 47 to produce a serial digital word corresponding to the chord at the output 56 of the Swell multiplexer or the output 57 of the Great multiplexer, respectively. The manner in which this is done is comparable to the manner of generating the serial data word described previously in conjunction with FIG. 1.

After the key stop register 49 has sampled all of the leads S1 through S12 and G1 through G12, it again applies a pulse on the S1/G1 output lead 50. This advances the octave register 52 to provide an enabling voltage on drive line D out of the octave register. If the C,E,G chord were still being held down in the first octave which was driven by the drive line C, no new serial data would be created out of either the Swell multiplexer 10*a* or Great multiplexer 10*b* since no enabling voltage would be present through a closed key switch 47. However, if during the time the drive line D was enabled, the C chord were played in the second octave of either of the Swell or Great keyboards, the C,E,G relationship discussed previously would again be present; and the multiplex signal out of either the Swell multiplexer 10*a* or the great multiplexer 10*b* would represent that C,E,G chord in the data stream, but at an octave higher than described previously when the C output drive lead was enabled by the octave register 52.

This sequence is illustrated in FIG. 7 where it can be seen that each of the drive leads C, D, E, and F are sequentially enabled for one octave and the sampling pulses from the key stop register for the notes of those octaves are represented immediately beneath the enabling waveforms which have been shown for the drive leads.

Of course, this sequence of events occurs very rapidly and the sequential enabling of the drive leads C through G also occurs rapidly; so that when the keyboard is played by a musician, the longest interval which occurs between the time when a key is scanned and when it is scanned again is about two milliseconds. This time is shorter than can be discerned by a human listener; so that the operation of the keyboard and the ultimate production of the sound appears to be instantaneous.

In the previous discussion, the enabling of the drive lines A and B from the interface buffers 53 was not discussed since the previous discussion was limited to the multiplexing of the keys of the Swell and Great keyboards only. In addition to the multiplexing of the keyboards, however, the stop controls of the organ are multiplexed. If this were not done, the stop control functions would greatly increase the number of pins required on the integrated circuit keyboard multiplexer 10, shown in FIGS. 5 and 6. This would increase the size and complexity of the chip or would require the keyboard multiplexer functions to be made in more than one chip.

To also multiplex the stop and coupler controls, an R-S flip-flop 59 initially is set by the output of a NOR gate 60 coupled to outputs of the key stop register 49 and the octave register 52 which decode the number 1 or first pulse of the total multiplex timing period or sequence through which these registers are driven. The flip-flop 59 is reset by the output of a NOR gate 62, which is supplied with inputs from the registers 49 and 52 representative of clock pulse number 23 applied on the clock pulse lead 45. The inverted output of the flip-flop 59 is applied to one input of an OR gate 64 which also is supplied with the clock pulses on the lead 45 of its other input. When the OR gate 64 is enabled by a negative output of the flip-flop 59, the positive clock pulses on the lead 45 are passed as negative clock pulses on its output and are applied to the clock input of a 6-bit shift register 66 to advance the shift register in synchronism with the clock pulses.

The signal data stream passing from the output of the shift register 66 then is applied to the input of a 16-bit shift register 67, which also is advanced at the 55 kilohertz clock frequency by the clock pulses appearing on the output of the OR gate 64. The 16-bit shift register 67 is used to de-multiplex the time slots for the stop controls on the flutes of the organ. The 6-bit shift register 66 similarly de-multiplexes the time slots for the coupler controls for the strings and flutes when the flutes of the organ are on the "Couplers on Flute" coupler option.

Referring to FIGS. 6 and 7, it can be seen that the clock periods 1 through 16 occur during the time that drive pulses appear on output drive leads A and B from the interface buffers 53. The leads A and B are used for sampling the coupler stop controls. These are the first 16-bits scanned in each cycle of operation of the multiplexer; and, therefore, these bits are loaded into the 16-bit shift register. The following 6-bits of information are the intermanual and intramanual coupler controls. These also are sampled when drive pulses appear on the drive lead B. As shown in FIG. 5, the data output from the Swell multiplexer appearing on the lead 56 also is applied to a 24-bit shift register 69 which is continuously driven by the clock pulses appearing on the lead 45.

In addition, the output on the lead 56 from the Swell multiplexer section 10*a* is applied directly into a point marked S on a coupler control switching circuit 70. The circuit 70 includes three coincidence gates for intramanual coupling, one coupled with the S input, one coupled with the twelfth stage of the 24-bit shift register 69 (identified as the S12 input) and a third coupled with the output of the final stage of the 24-bit shift register 69 (identified as input S24). These three gates are enabled to pass the signals applied to their inputs by the output of stages 3, 2 and 1 of the 6-bit shift register 66, respectively. The same stages from the shift register 69, representative of the unit or undelayed signals, signals delayed by 12bits, signals delayed by 24 bits by the shift register 69 also are coupled to three additional coincidence gates in the coupler control circuit 70. These additional gates are enabled by the sixth, fifth and fourth stage outputs of the shift register 66, respectively, to apply the signals from the corresponding enabled gates on an output lead 96, which is an intermanual coupling between the Swell coupler control 70 and "S" input of the Great coupler control 70'.

The output of the coupler control applied to either of the leads 72 or 96 then comprises the serial bit information obtained from the outputs of any one or more of these gates in the coupler control circuit 70. If the serial data information applied through the coupler control circuit 70 is delayed 12 bits by the shift register 69, the output appearing on the lead 72 is shifted by one octave. If the serial bit data information is delayed by 24 clock pulses by the shift register 69, a two octave shift occurs. Thus, the coupler control circuit 70 is capable of passing undelayed serial data signals to its output (by way of its S input), signals delayed by 12 bits (one octave delay) or signals delayed by 24 bits (two octave delay). Stated in other words, the information coming in on the input S of the coupler control circuit 70 is a 16-foot string, delayed by 12 bits that information corresponds to the 8-foot string, and delayed by 24 bits the information comprises a 4-foot string. Comparable relationships exist with the signals which are applied on the intermanual coupling output lead 96.

The composite serial signal data stream then is applied from the output of the coupler control 70 on a lead 72 which supplies the serial data signal to the input of a 12-bit delay shift register 74. Since the unit flute takes the same serial data from the 12-bit delay tap on the 24-bit shift register 69 and outputs it directly as 16-foot pitch and delays the same signal 12 bits to provide 8-foot pitch, the string data signal must also have a 12-bit delay to line up the flute and string time slots properly. If this was not done, a particular time slot would be at one pitch reference (i.e. 16-foot) for flutes and at another pitch reference (i.e. 8-foot) for strings.

The data on the output lead 72 from the coupler control circuit 70 also is applied to an input $S_C$ of a flute mode control circuit 75. A second input labeles S12 for the flute mode control circuit 75 is obtained from the twelfth stage or twelfth bit delay output of the shift register 69. Two other inputs to the flute mode control circuit 75 comprise the normal and inverted outputs of stage 16 of the 16-bit shift register 67, and these two inputs operate as the enable voltages for the flute mode control circuit 75. If an enable output voltabe is obtained from the 16th stage or output of the shift register 67, it indicates operation of the couplers on a flute option. When the couplers are enabled, the coupler control information comes in on the two inputs labeled $S_C$ and S12 of the mode control circuit 75 and is fed into the 55-bit shift register 78 and a stop control circuit 80. The data information on lead 72 is fed through the flute mode control circuit 75 when the "Coupler on Flute" mode control circuit 75 is enabled. This output then is coupled directly to an input of a stop control circuit 80 and is coupled into the left-hand side of a 55-bit shift register 78 which is driven at the basic 55 kilohertz clock frequency by the clock pulses present on the input terminal 45.

The flute mode control circuit 75 is supplied with the 12-bit delayed input signal from the shift register 69 when the Coupler on Flute mode control is disabled.

As the information is delayed down the shift register 78, it creates new pitch couplers. The information which is delayed by 12-bits in the shift register 78 becomes the 8-foot signal. As indicated on the numbered outputs from the 55-bit shift register 76, the delay between the 8-foot signal (output stage 12) and the next one (output stage 15) is three clock pulses or notes which becomes a minor third. The next difference is a one note difference which becomes the sixth and two-fifths; then from the sixth and two-fifths there is a delayed period which creates the five and one-third and another output stage 24 which is the 4-foot pitch, etc.

These taps on the 55-bit shift register 78 are sampled in coincidence gating circuits by the outputs obtained from the 16 stages of the shift register 67 for the first 16-bits of information that is carrying the flute stop and coupler control setting information. In other words, if the output from the fourth stage of the shift register 67 is enabled, it causes the flute output to become the unit six and two-fifths.

The output of the stop control circuit 80, which comprises the serial data signal stream with the transposed data bits corresponding to the selected stop and coupler controls included in it, is supplied through an inverter 81 to an FET driver transistor 83 to the swell flute line output from the multiplexer circuit.

The following chart shows the operation of the multiplexing system of FIGS. 5 and 6 for an entire clock period of zero to 134 clock pulses, which is the full cycle of operation required to scan all of the keyboards and control function stops of the system.

MATRIX SCANNING AND SYNCHRONIZATION

| Clock Period | Matrix Cell Address | Control Of Key Function(s) |
|---|---|---|
| 0 & 1 | A1 | Couplers on Unit Stop S/Couplers on Unit Stop G |
| 2 | A2 | Frame Timing Control |
| 3 | A3 | |
| 4 | A4 | Unit 2/3′ |
| 5 | A5 | Unit 4/5′ |
| 6 | A6 | Unit 1′ |
| 7 | A7 | Unit 1-1/3′ |
| 8 | A8 | Unit 1-3/5′ |
| 9 | A9 | Unit 2′ |
| 10 | A10 | Unit 2-2/3′ |
| 11 | A11 | Unit 4′ |
| 12 | A12 | Unit 5-1/3′ |
| 13 | B1 | Unit 6-2/5′ |
| 14 | B2 | Unit Minor 3rd |
| 15 | B3 | Unit 8′ |
| 16 | B4 | Unit 16′ |
| 17 | B5 | Kbd G to Kbd S 4′/Kbd S to Kbd G 4′ |
| 18 | B6 | Kbd G to Kbd S 8′/Kbd S to Kbd G 8′ |
| 19 | B7 | Kbd G to Kbd S 16′/Kbd S to Kbd G 16′ |
| 20 | B8 | Kbd S to Kbd S 4′/Kbd G to Kbd G 4′ |
| 21 | B9 | Kbd S 8′ Off/Kbd G 8′ Off |
| 22 | B10 | Kbd S to Kbd S 16′/Kbd G to Kbd G 16′ |
| 23 | B11 | No Inputs Scanned |
| 24 | B12 | Key C2 Scanned, Note $C_0$ Data Output |
| 25 | C1 | Key C # 2 Scanned, Note C # 0 Data Output |
| 26 thru 84 | C2 thru G12 | Keys D2 thru Scanned, C7 — Note Do thru Output, C5 |
| 85 thru 133 or 145 | "H1" thru "L1" or "M1" | No Inputs Scanned continuation of Note C # 5 to C # 9 data processing or C # 10 output |
| 134 or 146 | "L2" or "M2" | Sync. Pulse Generated |
| 0 & 1 | A1 | Couplers on Unit Stop S/Couplers on Unit Stop G |
| etc. | etc. | etc. |

(kbd in above chart stands for keyboard)

(kdb in above chart stands for keyboard).

It should be noted that when 23 clock pulses applied to the input terminal 45 have been counted by the key stop register 49 and octave register 52, an output pulse is produced by the NOR gate 62 to reset the flip-flop 59. This disables the OR gate 64, causing its input to go high. Thus, no further negative clock pulses are passed through the OR gate 64 to advance the shift registers 66 and 67. As a consequence, the first 22-bits of information are stored in the shift registers 66 and 67 to cause the coupler control circuit 70 and the stop control circuit 80 to operate to effect the desired coupler and stop information, as described previously, for the remainder of the serial data signal train which is applied through the stop control circuit 80 and the 55-bit shift register 78 from the output of the Couplers on Flute mode control circuit 75. As a consequence, the coupler control and stop information is added into the serial data train in accordance with the settings of the coupler and stop control switches 47 at the cross-points of drive leads A and B, as shown in FIG. 6.

The scanning of the keyboards then takes place during clock periods 24 through 84, as shown in FIG. 7. The keyboard data from the swell multiplexer on the lead 56 into coupler control 70 also passes through the 24-bit shift register 69 and through the appropriate settings of the coupler control circuit 70 to the output lead 72. This information then is delayed by the 12-bit delay shift register 74 and is applied directly through an inverter 85 and an FET buffer amplifier transistor 86 to produce the swell string output for the swell multiplexer section 10*a*. At this time, it should be noted that the shift registers 69, 74 and 78 continue to operate under the control of the clock pulses on the terminal 45, even though operation of the shift registers 66 and 67 terminated upon receipt of the 23rd clock pulse.

During the application of clock pulses 85 through 133, a continuation of data processing of the stop and coupler control signals passing from the output of the stop control circuit 80 is effected, and this is illustrated in FIG. 7. It is during this time period that the notes C5 # to C9 # are produced on the output of the swell flute buffer amplifier transistor 83.

When clock pulse No. 134 is counted by the key stop register 49 and octave register 52, outputs from those registers indicative of count 134 are applied to the inputs of an NOR gate 87, along with the output from stage 15 of the 16-bit shift register 67 which is used to disable the frame expansion mode, to produce a negative-going output at count 134. This pulse is applied to the base of an FET buffer transistor 88 to drive the transistor into conduction, which in turn applies a negative strobe pulse on a strobe/reset output terminal 90 for use in the de-multiplexing operation of the system. This same negative pulse also is applied to a reset delay circuit 91 which operates to produce a reset output pulse through an inverter 92 upon the application of the next clock pulse (the zero clock pulse) to it, which causes the registers 49 and 52 to be reset, initiating a new cycle of operation of the multiplexing system. Clock pulse No. 1 then resets the flip-flop 59 and the cycle of operation is repeated.

Hence, the length of the serial data train is at least equal to the product of the number of key switches for one keyboard and the time required to scan one key switch.

The above description has been made with reference to the output of the swell multiplexer 10*a* and the processing for the control and key functions for that multiplexer. The operation of the great multiplexer section 10*b* of the keyboard multiplexer 10 is a mirror image of the swell multiplexer operation and includes shift registers, coupler control circuitry and stop control circuitry which is the same as and operates in a similar manner to that which has been described for the swell multiplexer. The circuits in the great multiplexer portion of the system shown in FIGS. 5A and 5B which operate the same as those in the swell multiplexer portion are given the same reference numbers as in the swell section of the circuit, but with the reference numbers being primed for the great multiplexer. For example, a coupler control circuit 70′ in the great multiplexer circuit operates in the same way as the coupler control circuit 70 in the swell multiplexer portion of the circuit of FIG. 5.

Intermanual coupling is effected by supplying the signals from output S of the great coupler control 70′ over a lead 95 to the swell coupler control 70 and by supplying the lead signals from the swell coupler control 70 over a lead 96 to the input of the great coupler control 70′.

The data signal train for the great flute output is applied from the output of the stop control circuit 80′ through an inverter 97 and a buffer FET amplifier 98 to a great flute output terminal. Similarly, the great string output is applied from the output of the 12-bit delay shift register 74′, through an inverter 99 and an FET buffer amplifier transistor 100 as shown in both FIGS. 5 and 6.

The operation of the circuit disclosed in FIGS. 5, 6 and 7 has been discussed in conjunction with a clock pulse cycle of 134 clock pulses. This permits data processing of notes produced by the couplers and stops from Co through C9 # including the notes directly reproduced by the keyboards. If processing of data up to C10 # is desired in an organ, the same system disclosed in FIG. 5 may be used; but instead of initiating the strobe/reset pulse by the operation of the NOR gate 87 at count 134, the input to the AND gate 87 would be disabled. A second NOR gatee 101 with an input from the octave register when it reaches an octave count of 13 and an input from the key stop register 49 when it reaches count 2 then can be used to generate the strobe/reset pulse at a count of 146. This output pulse would be used to drive a buffer FET transistor 103, the output of which is connected in parallel with the output of the transistor 88, to generate the reset pulse applied to the reset delay circuit 91 and to the strobe/reset output terminal 90. When a time cycle of 134 clock periods is desired, the inputs to the NOR gate 101 are disabled and the NOR gate 87 control is enabled.

Figure 8C:
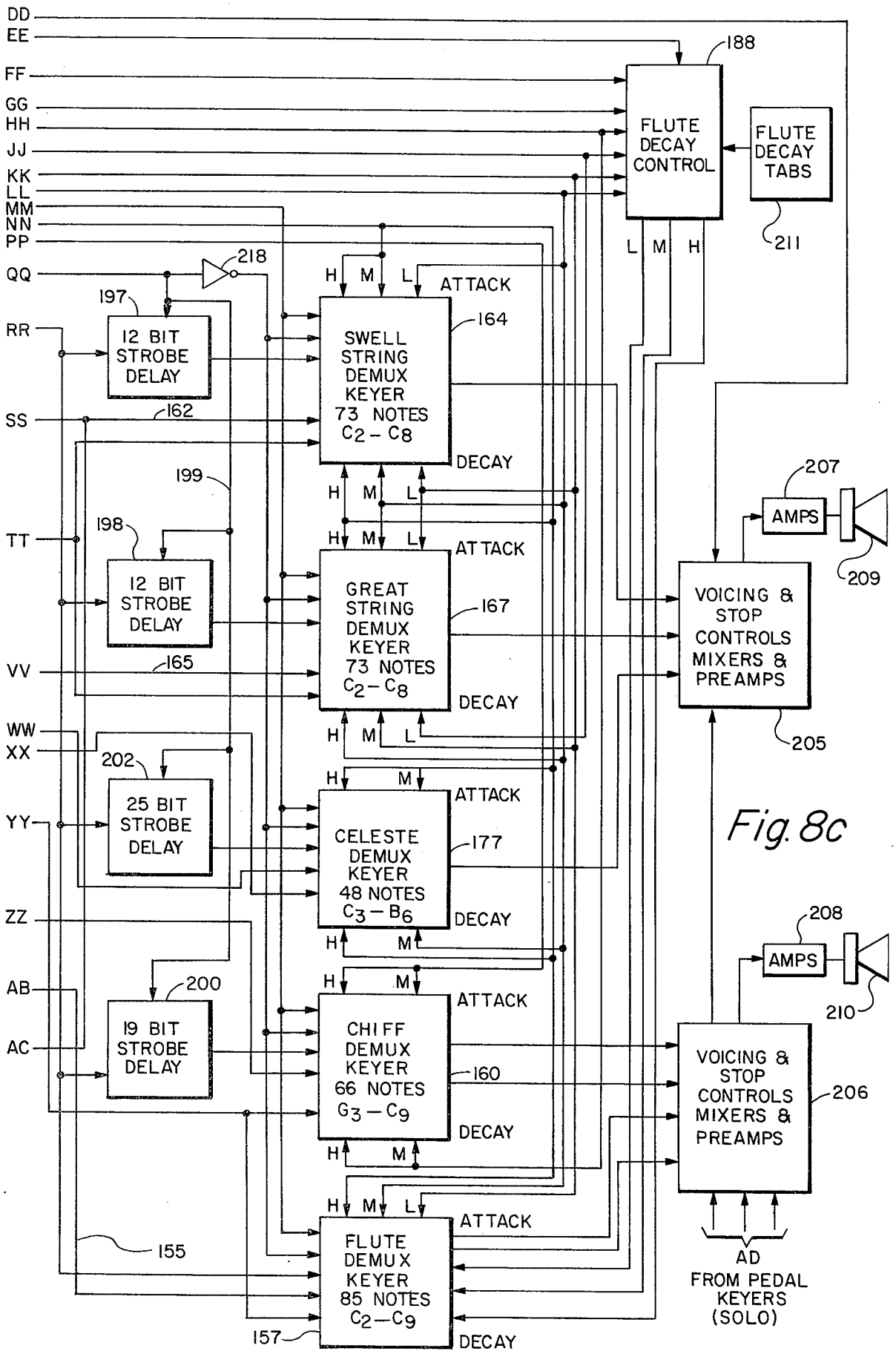

Reference now should be made to FIG. 8 which is divided into three sections, FIG. 8A, FIG. 8B, and FIG. 8C. These sections comprise a block diagram of a complete multiplex/de-multiplex organ system employing the principles described in conjunction with FIGS. 1 and 2 and utilizing a multiplexing circuit of the type described in conjunction with FIGS. 5, 6 and 7. The interconnection leads between FIGS. 8A and 8B to complete the composite block diagram are identified by letters at the right-hand edge of FIG. 8A, at the left and right-hand edges of FIG. 8B (which constitutes the central figure of the schematic) and at the left-hand edge of FIG. 8C, which comprises the right-hand third of the circuit disclosed in FIG. 8.

Central to the synchronized operation of the multiplexing and de-multiplexing operation of the system disclosed in FIG. 8 is a digital clock generator comprising a scanning clock frequency generator 110 to produce a basic 330 kilohertz scan clock frequency in the form of a ±5 volts squarewave output utilized in the system to produce the various interrelated frequencies employed to operate the system. The output of the scan clock generator 110 is applied through a buffer amplifier 111 to supply scanning clock pulses at the 330 kilohertz rate on a lead 112 to operate the de-multiplexer keyer portions of the system. The operation of this portion of the system will be described in greater detail subsequently.

The 330 kilohertz basic clock frequency is applied through a divide-by-three circuit 114 to produce a 110 kilohertz frequency at its output. This signal in turn is supplied to fourteen cascaded divide-by-two circuits 116, which produce at their outputs squarewave signals ranging from a 55 kilohertz signals form the first of the cascaded frequency dividers 116, on down to a 6.7 hertz frequency available from the final or fourteenth stage.

The 55 kilohertz frequency from the first divide-by-two stage 116 is applied over a lead 117 and comprises the clock pulses which are applied to the terminal 45 for the multiplexer circuits 10 and 13 of FIG. 8 and the multiplexer circuit shown in detail in FIG. 5. Other different frequency outputs from the frequency divider stages 116 are utilized to provide different attack and decay frequencies for the different keyers used in the de-multiplexing/keying portion of the system.

The manual multiplexer 10 shown in FIG. 8A comprises substantially the circuit of FIG. 5A and 5B to produce four serial words or multiplex digital data streams corresponding to outputs representative of the swell string, swell flute, great string, and great flute appearing on leads 120, 121, 122 and 123, respectively. These leads are applied to buffer inverters 83, 86, 98 and 100 respectively, which correspond to the buffer inverters shown in greater detail in FIG. 5B. In FIG. 8A, the manual multiplexer and its input and output buffer circuits for operating and sampling the coupler controls and the keyboards are represented in block form only, since the details of these circuits are shown in FIGS. 5 and 6.

The swell keyboard 126 is sampled by the multiplexer circuit 10 through the buffer inverts 53 in the manner described previously, to supply a time-division multiplexed serial data stream on the leads 120, 121. Similarly, the swell coupler control 127 has the appropriate key switches 47 (FIG. 6) operated in response to the operation of conventional swell coupler tabs 128 functioning through a diode matrix 129 to close the appropriate ones of the swell coupler cross-point switches 47 representative of the information for the selected tabs. The switches 47 in the swell coupler control circuit 127 also may be operated by the use of preset buttons 130, functioning through a memory circuit 131 of conventional design and the diode matrix 129, if this additional degree of control is desired. Such preset buttons 130 are employed to simulate the operation of pre-established combinations of tabs and coupler controls, without the necessity of the musician individually operating the tabs to obtain the same combinations. The effect in the swell coupler control circuit 127, however, is the same as is accomplished by the use of individual tabs 128.

A great keyboard 126', a great coupler control circuit 127', a diode matrix 129' and great coupler tabs 128' operate similarly to the swell keyboard, swell coupler tabs and swell control circuit to supply the great keyboard and control information to the multiplexer circuit 10 in the manner described previously in conjuction with FIGS. 5 and 6.

In addition to the manual multiplexer 10 for multiplexing the swell, tab and coupler information for the swell and great keyboards, there is a pedal multiplexer 131, which is the same as the multiplexer 10 but which is used to multiplex the notes from the pedal board and the pedal stop and coupler control tabs. The pedal board 132 may be of conventional design. A single pedal switch is illustrated (of the twelve or more actually used) which supplies the pedal switch information parallel on two output leads 133 and 134. The lead 133 is applied to the swell portion of the pedal multiplexer circuit 131 and the information on the lead 134 is supplied to the great multiplexer portion of the multiplexer circuit 131. Thus, the same note information is processed in both sections of the multiplexer 131.

The manner of operation of the multiplexer circuit 131 is the same as the operation of the manual multiplexer described in conjunction with FIGS. 5 and 6. In addition, to the pedal switches, there are swell and great pedal coupler intermanual control circuits 136 and 137, respectively, which are operated by the swell and great coupler tabs functioning through the swell and great coupler control circuits 127 and 127'. In addition, pedal coupler control tabs 139, of conventional type, operate through a diode matrix 140 and an additional pedal coupler control circuit 141, to provide stop and coupler controls for the pedal multiplexer. The control circuit 141 also controls a pair of A and B enable gates 142 and 143 for permitting the drive pulses on the A and B drive lines from the buffer inverter circuit 145 to be applied to the intermanual swell pedal coupler control 136 and the intermanual great pedal coupler control 137. This is accomplished in accordance with selected ones of the pedal coupler tabs to produce this intermanual coupling between the swell and great manuals and the pedal multiplexer.

The pedal multiplexer supplies drive pulses on drive lines A, B, C, D and E, which correspond to the same lettered drive lines from the manual multiplexer 10, to sample the pedal tabs and coupler controls and the pedal switches 132 to produce four serial words or signal data streams from the pedal multiplexer, namely, swell flute, swell string, great flute, and great string, on output leads 147, 148, 149 and 150, respectively. These output leads are coupled through buffer inverters 152 which are comparable to the buffer inverters 83, 86, 98 and 100 used for the output of the manual multiplexer 10.

As indicated in FIG. 6, it is possible to combine each of these four different outputs from different multiplexers together to produce a single composite multiplexed signal for each of the four serial words representative of all of the multiplexed information. This is accomplished in the circuit of FIG. 8 by combining together the outputs of the buffer inverters 83 and 98, through isolating diodes, with the outputs of the buffer inverters for the swell flute and great flute output leads 147 and 149 to form a single composite serial data signal on a lead 155. This composite signal represents the entire multiplexed flute signal for all of the manual and pedal keyboards and the coupler control circuits. This multiplexed signal is applied over the lead 155 to the data input of a flute demultiplexer keyer circuit 157 which has a capacity for keying 85 notes ranging from C2 to C9.

This same flute data is applied over a lead 158 to the input of a 270-bit data processor circuit 159, the output of which is coupled to the input of a chiff demultiplexer keyer 160 used to add chiff to the flute tones in the signal which is finally reproduced by the organ. The data processor 159 operates to limit the time duration of any flute tone data pulse applied to it a maximum duration of two of the 135-bit basic clock periods of the system. Thus, even though a flute tone may be played legato or sustained for a prolonged period of time, the information corresponding to that tone which is applied to the chiff de-multiplexer keyer 160 is supplied in the form of a short percussive striking and release of the key or note being processed. The manner in which this is accomplished is discussed in greater detail subsequently in conjunction with FIG. 9.

In a similar manner, the output of the swell string buffer amplifier 86 for the manual multiplexer and the swell string output 148 applied through the buffer inverters 152 of the pedal multiplexer are combined through isolating diodes and applied over an input lead 162 to a swell string de-multiplexer keyer 164, having a capacity for processing the 73 notes C2 to C8. The manual multiplexer great string output obtained from the buffer inverter 100 and the great string output applied over the lead 150 and through the buffer inverters 152 for the pedal multiplexer also are combined through isolating diodes and applied over a common input lead 165 to the input of a great string demultiplexer keyer 167 having a capacity for processing 73 notes C2 to C8.

The swell and great string outputs of the manual multiplexer 10 and the swell and great string outputs of the pedal multiplexer 31 are combined respectively together and supplied as swell and great inputs to a celeste control gate 170. This gate either blocks or passes the serial data pulses representative of the string information in accordance with the output of a diode matrix 171 to which inputs from swell and great celeste tabs 173 are applied. If either or both of the swell and great celeste tabs are operated, the celeste control circuit 170 passes the respective serial data stream (swell or great) to its output. The selected data stream, or a combination of both data streams, is applied over an input lead 175 coupled to the input of a celeste demultiplexer keyer 177, having a capacity for processing 48 notes C3 to B6.

The different capacities of the keyers 157, 160, 164, 167 and 177 are those which are commonly employed in electronic organs used to simulate the effects of pipe organs. There is no necessity that the keyers be of different lengths or capacities so far as the operation of the multiplexing system itself is concerned; but in utilization of the system with the standard tones produced by the different keyers, the different lengths or data processing capacities of the keyers are encountered.

The tone signals for the swell string and great string demultiplexer keyers 164 and 167 are produced by a conventional tone generator circuit 180 (FIG. 8A) which supplies the pulse signals corresponding to the string notes C2 to C8 over 73 output lines 181 in parallel to the C2 to C8 inputs of the swell and string demultiplexer keyer circuits 164 and 167. Similarly, a different section of the tone generator circuit 180 supplies the 85 sine-wave flute tones for the notes C2 to C9 over the 85 output lines 183 in parallel to the inputs of the flute demultiplexer keyer circuit 157 and the chiff demultiplexer keyer circuit 160. (The keyer 160 receives only 66 of these tones, as described earlier.)

A tremolo circuit 184 is used to add tremolo to the flute tones when it is operated by a conventional tremolo stop. If a coupler tab for "chime" is selected by a great coupler tab circuit 128', an output is produced through a tremolo kill circuit 186 and is applied to a gate in the tremolo stop control circuit 184 to prevent the application of tremolo to the flute tone generators whenever the chime tab is selected. This is done to prevent undesirable sound effects from being produced by the organ when the chime tab is selected. Selection of the chime tab also supplies an input to a flute decay control circuit (FIG. 8C) 188 to select, through appropriate coincidence gates in the circuit 188, a long chime sustain output applied to the decay input of the flute multiplexer keyer circuit 157.

A celeste tone generator 190 supplied 48 tones C3 to B6 to the corresponding tone inputs of the celeste multiplex keyer 177 over 48 input lines 191, each corresponding to a different tone. These tones comprise a mixture of a squarewave signal and a stairstep waveform to produce the desired celeste tone effect.

Upon the occurrence of the 134th clock period, a strobe reset pulse is supplied from the output lead 90 from the manual multiplexer 10 to the same input of the pedal multiplexer 131 which is slaved to the operation of the manual multiplexer 10. In the pedal multiplexer 131, the NOR gate corresponding to the NOR gate 87, shown in FIG. 5A, is disabled; so that the strobe reset pulse on the common terminal 90 of the two multiplexers is supplied solely by the manual multiplexer 10. This causes the resetting of the pedal multiplexer 131 to be slaved to and synchronized with he operation of the manual multiplexer 10.

This strobe pulse on the lead 90 also is applied at time interval 134 to the input of a strobe pulse conditioner circuit 193, which also is supplied with the 55 kilohertz clock pulse. The circuit 193 operates to sharpen the frame time definition of the strobe pulse. This is accomplished by adding the clock pulse and the raw strobe pulse from the multiplexer together to prevent any output from the circuit 193 until the end of the first half of the clock period 134 when the clock is going negative. The new strobe pulse obtained from the output of the strobe pulse conditioner 193 is a negative pulse. When the clock pulse on the lead 117 goes positive again, the strobe pulse is terminated; so that the reshaped strobe pulse is a squared up pulse of one-half a clock period duration. This pulse is applied through a buffer inverter circuit 194 to produce a strobe pulse output on the lead 196, applied directly to the strobe input of the flute demultiplexer keyer 157 to cause the data passing through that keyer to be transferred into latch circuits of the type described in FIGS. 2 and 4.

Since the different keyers 157, 160, 164, 167 and 177 are of different lengths or different capacities, it is necessary to have the strobe pulse applied to them at different times in order to align the notes of these keyers with one another to produce the desired correct musical effect in the output of the organ. As noted previously, all of the serial digital data is supplied in parallel simultaneously to these keyers. At time interval 134, the note C9 is present in the first or input stage of the shift register circuits of each of the keyers 157, 160, 164, 167 and 177. This was the last note time slot produced in that data signal train. At this time, the desired 85 notes for the flute de-multiplexer keyer 157 are present in that keyer and they are aligned in the proper time slots. Thus, the strobe pulse is applied at time interval 134 to transfer the data in the shift registers of the keyer 157 to the latch circuits of the keyer.

The swell and string demultiplexer keyers 164 and 167, however, do not produce the note C9; so that if they were strobed at this time, improper tones would be obtained from their outputs. Since these keyers have a 73 key note capacity extending from C2 to C8, it is necessary to delay the strobe 12-bits so that these keyers are not strobed until processing of the first 12 data pulses of the next clock period has occurred. This then causes one octave's worth of information of the previous 135-bit clock period to be shifted out of the demultiplexer keyers 164 and 167. The first stage, or the input stage, of the shift registers of these keyers 164 and 167 then includes the note C8 of the previous clock period cycle of operation, with the succeeding stages in these two de-multiplexer keyers including the remainder of the notes on down to C2 in the proper alignment. Thus, after a 12-bit delay, which can be accomplished by simple 12-stage shift registers 197 and 198, operated at the basis 55 kilohertz clock frequency applied over a clock input lead 199, the strobe pulse is applied to the multiplexers 164 and 167.

Similarly, it is necessary to delay the strobe for the chiff de-multiplexer keyer 160 by 19-bits in a 19-bit shift register delay circuit 200 and to delay the strobe for the celeste de-muliplexer keyer 177 by 25-bits in a 25-bit shift register delay circuit 202.

Although the keyers are not all operated at the same time to latch or store the data passing through them, this cannot be detected in the operation of the system. By utilizing the shift register strobe delay circuits 197, 198, 200 and 202, it is possible to reduce the number of keyer stages which would otherwise be required to give the keyers equal capacity, with the outputs then being taken from different ones of the stages of the keyers aligned with one another in parallel. The shift register delay circuits 197, 198, 200 and 202 are much less complex and are substantially less costly than the keyer circuit sections which they replace.

The outputs of the keyers are supplied to conventional voicing and stop control mixers and pre-amplifier circuits 205 and 206. The outputs of these circuits then are supplied through output amplifiers 207 and 208, respectively, to loudspeakers 209 and 210 of the organ.

As is described subsequently in conjunction with the operation of the keyer circuits of FIGS. 10, 11 and 12, different attack and decay frequencies are supplied to the keyers 157, 160, 164, 167 and 177 from the outputs of different stages of the frequency dividers 116. These connections are indicated in FIG. 8C by labeling them high (H), medium (M) and low (L) for different relative frequencies utilized to control the attach and decay times of the tones produced by the respective keyers. Flute decay tabs 211 are used to control various gates in the flute decay control circuit 188 to change the decay frequencies of the tones produced by the flute de-multiplexer keyer 157 in accordance with the tonal effect desired.

The production of the 16-foot notes C1 to G3 and the 8-foot notes C2 to G4 of the pedalboard in the system shown is done in a conventional manner without utilizing multiplexer. The pedal switches for these notes are coupled through 32 leads 212 from the appropriate pedal switches 132. These leads 212 operate a solo pedal generator 214 to produce corresponding control voltages supplied to pedal keyers 216 in the form of voltage controlled oscillators, which supply the desired tones for these low pedal notes to the voicing and stop controls, mixers, and pre-amplifier circuits 206. These tones then are combined with the tones from the multiplexing system for reproduction in the loudspeaker 210.

Referring now to FIG. 9, there is shown in greater detail the 270-bit data processor circuit 159 which is used to produce the chiff for the flute tones. To create chiff, the processor 159 gives an output having the effect of a single pizzicato strike effect when a key is depressed. The chiff keyer being "struck" in this manner is the 2 ⅔ pitch of the 8' flute keyer being played at the same time. The attack clock frequency of all of the chiff keyers in the chiff de-multiplexer keyer circuit 160 is 13.75 kilohertz, or a fast attack. The decay clock frequency of all of the chiff keyers also is 107 hertz, or a reverbation decay. The chiff keyers are always keyed in parallel with the corresponding flute keyers since both of these keyers are supplied with the same flute digital data signal stream. A small amount of chiff is normally present with flute signals to produce the desired pipe organ effect.

In FIG. 9, the serial data on lead 158 is applied in to the input stage of a shift register having N times 135 stages. For the example shown in FIG. 8, N equals 2; so that the shift register 220 has 270 stages. The data on the lead 158 also is supplied through an inverter 221 to one of the two inputs of a two-input NAND gate 223. The other input to the gate 223 is supplied by the output of the shift register 220.

Assume that serial data now is first applied to the shift register 220 and the inver 221 on the lead 158. The normal output of the shift register 220 is a high or positive output. When the first negative data pulse then appears on the lead 158, it is inverted by the inverter 221 to a positive output pulse; so that both of the inputs to the NAND gate 223 are positive. This produces a negative data output pulse at the output of the NAND gate 223 and this constitutes the percussion data supplied in that time frame interval to the chiff de-multiplexer keyer 160. For the purposes of simplifying the description, assume that only one data pulse appears in the entire 135-bit time frame or timing period representative of only a single tone being played. The 55 kilohertz clock pulses shift this pulse on through the shift register, so that it appears in the middle of the shift register when the second multiplexing time frame takes place. At the second time frame, assuming the note is still held down, a negative pulse again appears and is inverted by the inverter 221 to a positive pulse and is passed by the NAND gate 223 as a second negative data output pulse to be supplied to the chiff de-multiplexer keyer, this pulse is stored in the appropriate latching circuit upon the application of a strobe pulse to that circuit from the 19-bit strobe delay circuit 200. At the beginning of the next or third multiplex time period cycle, the negative data pulse again appears on the lead 158 and is inverted by the inverter 221, as described previously; but this time it arrives at the input of the NAND gate 223 simultaneously with a negative going delayed pulse out of the shift register 220. This prevents the output of the NAND gate 223 from going negative, and no further data is obtained from the gate 223. This condition persists so long as the key or note for that data position is held down or played. When the note is released, the negative output pulses shifted out of the shift register have no effect since the NAND gate 223 is not enabled by these pulses.

When a data pulse in a given position re-appears or appears in a different position, the above sequence of operation is continued. Thus, the longest duration of a percussion data pulse at the output of the NAND gate 223 (and thus the output of the 270-bit data processor 159) is two time period intervals of the multiplex signal cycle. At the 55 kilohertz clock frequency, this produces the desired pizzicato effect.

The system will operate to produce the desired chiff or pizzicator effect for a shift register 220 having a length of only 135 stages, but two frame times of the multiplexer (270-bits) are used as a safety factor to guarantee that the data shows up on the output of the percussion processor in response to the playing of a key or keys by the musician.

Referring now to FIGS. 10, 11 12, 13 and 14, the operation of the de-multiplexer keyers 157, 160, 164, 167 and 177 will be described. These de-multiplexer keyer circuits all are operated by the 55 kilohertz clock frequency, but 180° out of phase with the clock applied to the multiplexer circuits 10 and 131. This phase reversal is provided by an inverter 218 (FIG. 8C) and is employed to insure that the data pulses have settled down before shifting them through the de-multiplexer keyer circuits. This is done to avoid possible errors which might be caused by "racing" conditions between the pulse generation by the multiplexers and the shifting of the information in the de-multiplexer sections of the keyers.

The keyers which are used in the keyer blocks 157, 160, 164, 167 and 177 preferably are of the form disclosed in co-pending application Ser. No. 496,943, filed Aug. 13, 1974 and assigned to the same assignee as the present application. In that co-pending application, the keyer inputs which are used to control the application of tone signals from an input to a tone signal output are indicated simply by the closure of a single-pole, single-throw switch. That simple switch configuration is replaced in the present system by a shift register and latching circuit of the type shown in FIG. 2 which, with appropriate gates coupled to the output buffers B1 through B12 for each octave, permits the key and coupler information to be scanned and to effect the operation of the keyer. The keyer may take a number of different forms, but the form of the keyer illustrated in FIGS. 10, 11, 12 and 13 provides substantial flexibility in the control of the attack and decay waveforms and permits the effective utilization of MOS integrated circuit techniques.

Figure 10:
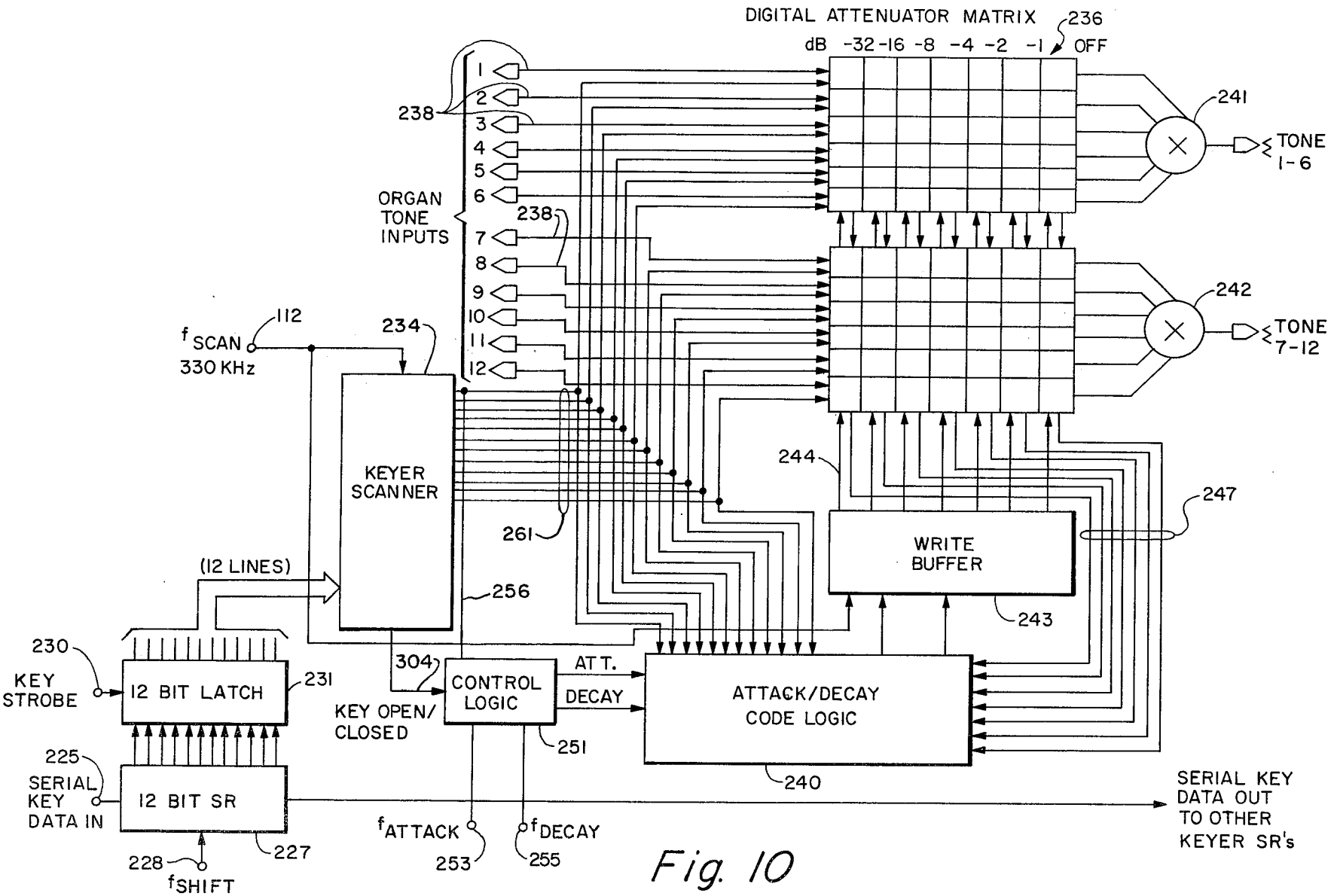
FIG. 10 is a more detailed block diagram of a portion of the circuit shown in FIG. 8C.

Referring now to FIG. 10, the serial data input to any one of the keyer circuits, 157, 160, 164, 167 or 177 (FIG. 8) is applied to an input terminal 225. All of the keyers shown in FIG. 8 are similar. Each of these keyers is arranged to process the serial multiplexed data in blocks of 12 data pulses, each block of data representative of a different octave of notes. For example, the celeste de-multiplex keyer 177 includes four serial sections of the type shown in FIG. 10, which illustrates the keyer components necessary for de-multiplexing and keying the notes for one octave. Similarly the flute de-multiplex keyer 157 includes additional sections to accommodate the full 85 note capability or capacity of that keyer.

The serial data input on the lead 225 is supplied to a 12-bit shift register 227 which is supplied with the shift pulses at the 55 kilohertz frequency from the output of the inverter 218 on a lead 228 (FIG. 8C). The output of the shift register 227 then is supplied as the input to the next shift register in the keyer, with the number of shift registers depending upon the capacity of the keyer as described previously.

Once the serial key data applied to the terminal 225 is properly aligned or in position to present the octave of notes to be decoded and keyed by the circuit of FIG. 10 inside the shift register 227, a key strobe pulse is applied to an input terminal 230 of a 12-bit latching circuit 231, which corresponds to the latching circuit described previously in conjunction with FIG. 2. The key strobe pulse applied to the terminal 230 is the strobe pulse which has been described previously as applied to the keyers 157, 160, 164, 167 and 177.

The outputs of the latch circuit 231 then represent the key information, and this information is continually renewed or changed in accordance with the sampling provided by the key strobe pulse on the terminal 230. A change occurs in the state of any one of the stages of the latch circuit 231 only when there is a change in the operation of the keyer or coupler control in the multiplexing system to change the desired note. The 12 outputs from the latch circuit 231 are applied to corresponding inputs of a keyer scanner circuit 234 which consists of 12 OR gates, each one having one input from a different one of the 12 outputs of the latch circuit 231 and each having another input connected to scanning input leads 112 (similar to those of FIG. 1). The scanning rate is 1/12th of the 330 kilohertz scanning clock pulse rate F scan. This causes each of the outputs of the latch circuit 231 to be sequentially and repetitively scanned at 1/12th of the 330 kilohertz scanning clock frequency. The scanning is also connected from the scanner 234 to leads 261 of the digital attenuator matrix 236.

Each horizontal row of the cells of the attenuator or matrix 236 includes an attenuator network of the type described in the aforementioned co-pending application, Ser. No. 496,943. FIGS. 11 and 12 show details of two different arrangements of circuit configurations which may be used for the attenuator cells. The outputs from the keyer scanner circuit 234 comprise a sequence of pulsed outputs, and these outputs are used to continually enabel and renew the information in the attenuator matrix cells to permit the passage of the tone signals applied to 12 tone inputs 238 for the octave being decoded.

The 12 scanning lines 261 from keyer scanner 234 also are connected to the attack/decay code logic circuit 240 and circuitry for controlling the operation of the seven attenuator cells in each horizontal row of cells connected in series between each of tone generator input leads 238 and the corresponding output from the attentuator matrix 236. Six of these outputs are combined in common in a mixer circuit 241, and the other six outputs are combined in a mixer circuit 242. All of the outputs of comparable mixers in all of the octave keying sections of each of the de-multiplexer keyer circuits of FIG. 8 are combined together to produce the single composite output from each of the keyers 157, 160, 164, 167 and 177.

The output of the attack/decay code logic 240 is applied through write buffer amplifier circuits 243 to refresh the attenuator cells. The output leads 244 from the write buffer circuits 243 are each connected in parallel to a different vertical row of the input gates of the cells in the attenuator matrix 236 (FIG. 1). The state of each of the attenuator stages is read or sampled by seven output leads 247, each of which is connected in parallel to corresponding vertically aligned cells of each of the attenuators for the 12 notes represented by the octave keyer section of FIG. 10.

The information on the leads 247, along with the information representative of the key operation from the keyer scanner 234, is applied to the attack/sustain code logic circuit 240. The circuit 240 is supplied with attack and decay signals through a control logic circuit 251, which has a preselected attack frequency applied to an input lead 253 and a preselected decay frequency applied to a lead 255 from outputs of the dividers 116 of FIG. 8. These frequencies can be fixed for any particular keyer or can be varied, as in the case of the flutes, by adjustment of the flute decay tabs 211 to cause different output frequencies to be obtained from the flute decay control circuit 188, described previously in conjunction with FIG. 8.

The control logic circuit 251 applies either an attack pulse, a decay pulse, or neither depending upon the key open/closed information supplied to it from the key scanner 234 over lead 304 and the present and previous state of both the f attack and f decay frequencies from the start of one keyer scan to the next scan.

Figure 14:
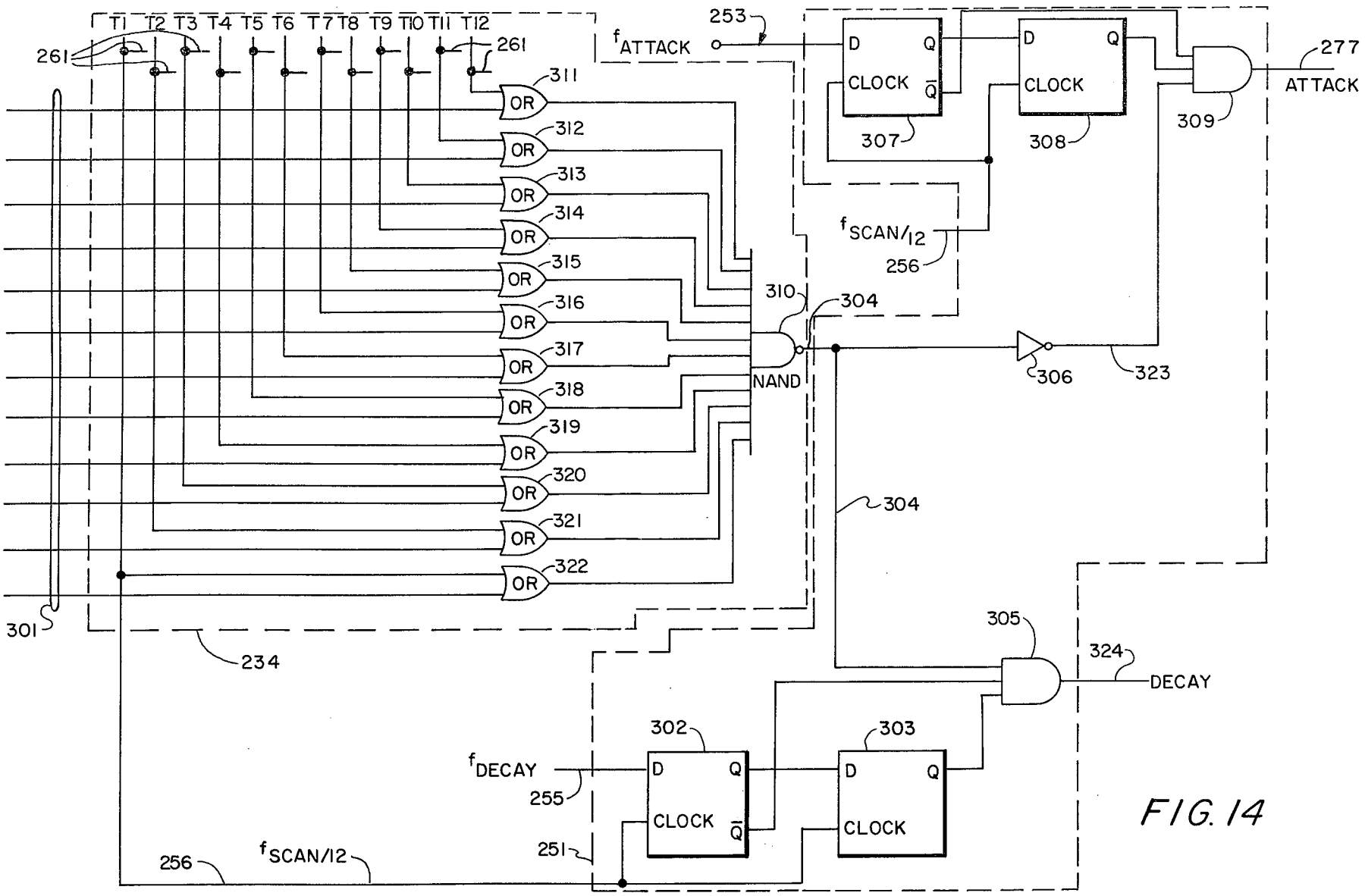
FIG. 14 illustrates details of another portion of the circuit shown in FIG. 10.

The control logic 251 can assume a number of conventional configurations, one of which is shown in FIG. 14. The keyer scanner 234 scans lines 301 from 12-bit latch 231 (FIG. 14). The 12 OR gates 311 thru 322 and NAND gate 310 operate as did the multiplexer described in FIG. 1. The output 304 from NAND gate 310 indicates a key up if the corresponding time slot is at logic zero and a key down if the corresponding time slot is logic one. This signal is inverted by an inverter 306 and is connected to an AND gate 277 by a line 323. Once each scan period, f attack 253 is shifted into a two-stage shift register 307, 308. When f attack is at logic one at the beginning of one scan and logic zero at the beginning of the next scan frame, the AND gate 309 is enabled, permitting an output line 277 to become logic one if line 323 is at logic one and logic zero if line 323 is at logic zero. Similarly line 304 is connected to an AND gate 305. F decay is shifted into a two stage shift register 302, 303 and line 324 becomes logic one if f decay is at logic one at the beginning of one scan and logic zero at the beginning of the next scan frame. This condition enables the AND gate 305 permitting the output line 324 to become logic one if line 304 is at logic one and logic zero if line 304 is at logic zero.

These inputs to the attack/sustain code logic 240, coupled with the scanner inputs and the sampled outputs from the attenuator matrix on the leads 247 control the operation of the write buffer 243 to control the digital attenuator matrix 236 for each of the tone signal inputs in accordance with the techniques described in the aforementioned co-pending application.

Figure 11:
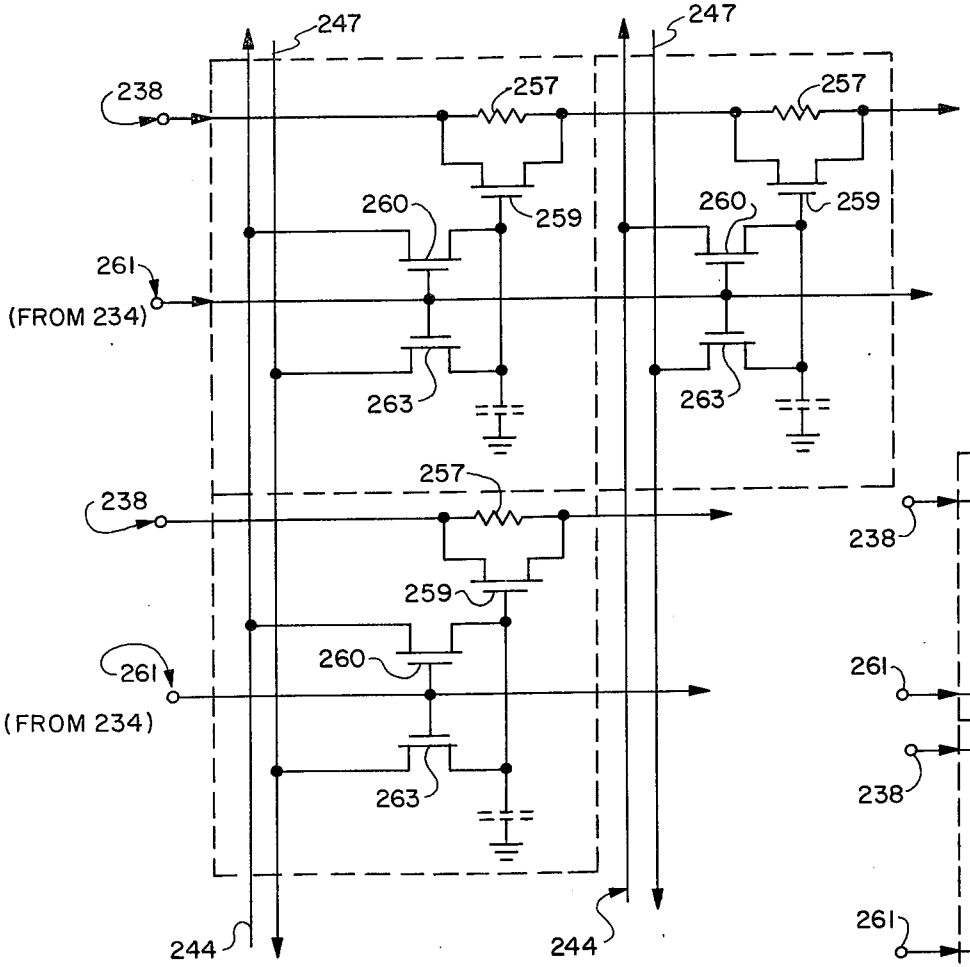
FIGS. 11 and 12 illustrate variations of circuits which can be used in a portion of the circuit shown in FIG. 10.

Referring now to FIG. 11, there is shown a detailed circuit diagram of a configuration which can be used for the memory cells of the digital attenuator matrix 236 shown in block form in FIG. 10. Three cells are shown in FIG. 11, each enclosed within dotted lines. Each of these cells corresponds to one of the rectangles of the attenuator matrix circuit 236. Each tone is applied to one end of a lead 238 which includes a resistor 257 in each of the seven cells connected in series to form the attenuator network for each of the tone signal input leads 238. Each of the resistors 257 is shunted by a field effect transistor 259, the conductivity of which is controlled by a field effect transistor switch 260. The field effect transistor 259 also comprises a memory, indicated by the capacitor shown in dotted lines connected between the gate of the transistor 259 and ground. The capacitor is shown in dotted lines because it constitutes the gate capacitance of the field effect transistor 259 and is not an additional component.

If an output from the keyer scanner circuit 234 is applied to the horizontal lead 261 for a particular key, the input state on lead 244 from the write buffer circuit 243 is enabled to pass through FET switch 260 to initiate or refresh the charge stored on the gate capacitance of transistor 259 and to either turn on or off the transistor 259 dependent on the charge present on its gate. This gate charge lasts long enough to maintain transistor 259 conductive until the next scanning cycle on the lead 261 causes a reapplication of input signal 244 through the FET switch 260 to the gate and gate storage capacitance of the transistor 259. By controlling the signals on the output leads 244 from the write buffer circuit 243 in conjunction with the output signals from the keyer scanner 234, the transistors 259 in the attentuator network are rendered conductive and nonconductive in various patterns to produce the desired attack, sustain, and decay waveforms needed to produce the desired tonal effects from the keyer.

The operated condition of each of the transistors 259 is sensed by an output or read FET switch 263 in each of the cells which senses the charge on the gate capacitance of transistor 259 and transfers it to the read or sense line 247 to control the attack/decay code logic of the circuit 240 for modifying the signals applied to the leads 244 in accordance with the desired state for each of the different attenuator networks.

Figure 12:
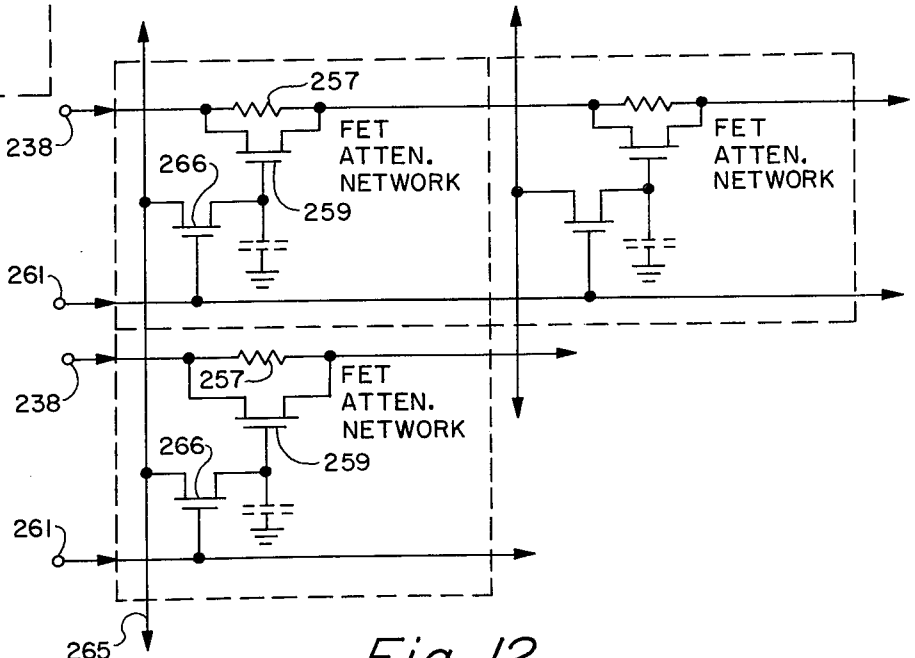

FIG. 12 shows another version of the cells which can be used in the attenuator matrix 236. This version is essentially the same as the circuit of FIG. 11, but it uses two field effect transistors per stage instead of three. The one FET switch and bus is removed and the other FET switch and bus is used for both reading and writing. In the circuit of FIG. 12, the read and write buses 244 and 247 are now combined in a single read/write bus 265 which is of the type commonly employed in LSI RAM circuits using a single FET memory cell. The operation of the memory cells of the circuit of FIG. 12, however, is the same as the operation described for FIG. 11, with the second FET transistor 266 performing the combined functions of FET switches 260 and 263 in a conventional manner.

Figure 13:
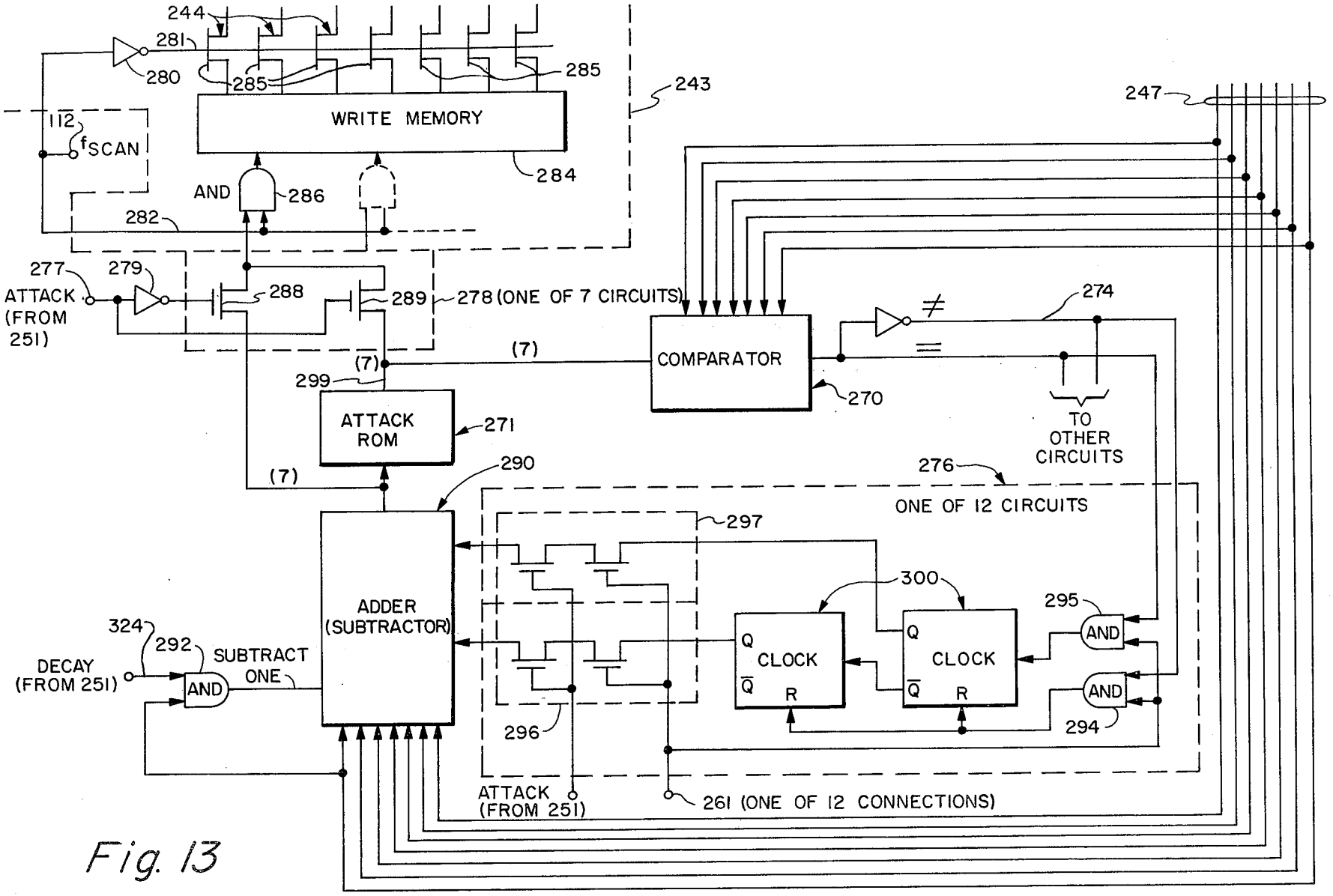
FIG. 13 illustrates details of a portion of the circuit shown in FIG. 10.

FIG. 13 shows additional details of the attack/decay code logic circuit 240 of FIG. 10. The function of the circuit of FIG. 13 is to control the attack, sustain and decay characteristics of the tone signals applied to each of the tone signal input leads 238 in response to the "opening" and "closing" of the keys represented by the outputs of the keyer scanner circuit 234 of FIG. 10. The manner in which this is accomplished is disclosed for a single key in co-pending application 496,943, and the circuitry of FIG. 13 shows the manner in which that logic is expanded to control the 12 keyers of an octave in a time-division multiplex mode of operation.

To operate in this manner, it is necessary to continually sample and update the charge on the gate capacitance of the transistors 259 in the atttenuator networks 236. When control logic 251 disables the attack line to the attack/decay code logic 240, FET switch networks 296 and 297 disconnect a counter 300 from an adder 290 in a control circuit 276. FET switches 289 in each of 7 circuits 279 are disabled and FET switches 288 are enabled via an inverter 279. This permits the information on the 7 output lines (only one is shown) of the adder 290 to pass through the corresponding FET switches 288 and through AND gates 286 when the read line 282 is activated.

Line 112 from f scan determines if the keyer is reading or writing information to and from the attenuator matrix 236. During the first half of each f scan period, information is stored temporarily in write memory 284 by means of AND gates 286 in circuit 243. When the second half of f scan period occurs, the input AND gates 286 to the write memory 284 are inhibited and the FET switches 285 connect the write memory to write the busses 244.

If the decay line also is disabled, the subtract one line at the output of an AND gate 292 is also disabled since the AND gate 292 is disabled. Since the adder 290 adds or subtracts nothing from the value read on the read lines 247 from the attenuator matrix 236, this same value is reread into the gate capacitance of transistors 259 to refresh the charge once each cycle. This is the sustain mode of operation of the circuit.

If the subtract one line is enabled (as occurs during the decay mode) the adder 290 becomes a subtractor and subtracts one from the value entering the adder 290 via the read lines 247. Thus, each time a decay pulse comes along the value stored by the gate capacitance of transistors 259 is decremented by one and stored back on the gate capacitors via the FET switches 288, AND gates 286, write memory 284, the FET switches 285, write busses 244, and the FET switches 260. This changed information to the attenuator matrix 236 on the leads 244 creates the desired decay waveform of the tone represented by the key which has been opened, until the point is reached that full attenuation of that tone representative of the full desired decay is obtained. This condition, is sensed when the read line from the off attenuator cell in matrix 236 inhibits AND gate 292 causing the subtract one line to go low preventing any additional decay pulses from entering the subtractor 290.

Whenever an attack pulse occurs, FET switch networks 296 and 297 are enabled, permitting the counter 300 in circuit 276 to be connected to the adder 290. The FET switches 288 are disabled and the FET switches 289 are enabled in the circuits 278. This disconnects the output of the adder 290 from the write memory 284 and connects the attack ROM 271 to the write memory 284 via the FET switches 289 and the AND gates 286. The attack ROM 271 is basically a "look up" table to determine the next attenuation level of the keyer. This can be a complex pattern which does not necessarily change the previous state by the same db level from state-to-state. As a result, for each attack pulse that occurs, the previous attenuation state can remain, or it can be one or several increments different in level depending upon the characteristic waveform desired. In the attack mode of operation, the previous attenuation step read on the leads 247 is applied to the adder 290 where the previous value is summed with the output of the circuit 276. The resultant value addresses the attack ROM 271 and the next attack db level is stored at this address in the attack ROM 271. This value is supplied on the 7 outputs of the attack ROM 271 on the lines 299 through the FET switches 289 in the circuit 278, through the AND gates 286 into the write memory 284, then through the FET switches 285, onto the write busses 244, through the FET switches 260 and then onto the gate storage capacitance of transistors 259.

Since it is possible for the state of the attack ROM 271 to remain the same as the previous state when it is addressed during a desired attack mode of operation, it would be possible to lock the system up into some level of pre-established attenuation for a key even though the attack sequence was not finished. This would occur whenever the comparator 270 indicated the lines 247 were in agreement with the output of the attack ROM 271. This would be similar to an infinite loop in a computer program where the system given one state would look up a new state (the same state) and go to this new state, on and on without ever completing the attack sequence from the ROM 271. To prevent this, the control circuits 276 are added which includes the two-bit counter stage 300 for each associated key.

Each time the state from the attack ROM on the leads 299 and the previous state on the leads 247 are matched or equal (as determined by the comparator 270), the counter 300 is incremented by a count of one, by the passage of a pulse through the AND gate 295. The counter 300 output then is applied to the adder 290 via the FET switch networks 296 and 297 to increment the addressing of the ROM 271 by incrementing the adder/subtractor circuit 290 by an additional count. The counter 300 is capable of adding zero, one, two or three to change the state of the adder/subtractor counter circuit 290 by these increments whenever the present and previous state of the ROM 271 are the same.

It should be noted that the control circuit 276 is only effective when the comparator output indicates that the two sets of inputs to it are equal. When the sets of inputs are unequal, the AND gate 294 passes a pulse from lead 274 indicating non equality to reset the counter 300 to zero. The counter remains in this state, and zero is added to adder 290 as long as the inputs to the comparator 270 on the leads 247 and the output of the ROM 271 do not match.

The multiplexing/de-multiplexing system which has been described uses an effective configuration of integrated MOS circuits to produce a time-division multiplexed digital signal train representative of the key switch closures on all of the keyboards and pedalboards in the organ. The system further provides for efficient processing of the digital data in the different de-multiplexing keyer circuits 157, 160, 164, 167 and 177 by use of the different strobe pulse delays applied to these keyers to minimize the total number of octave keyer sections which msut be used in the system. By multiplexing the control tabs and keyer outputs together, the number of bonding pads required on the MOS multiplexing chips are reduced, resulting in efficient use of chip area.

I claim:

1. In an electronic musical instrument having at least first and second pluralities of key switches for each of first and second keyboards, respectively, including in combination:

first means for simultaneously scanning said key switches in said first and second pluralities thereof sequentially and repetitively to detect actuation of any one or more key switches in each of said pluralities;

second means coupled with the output of said first means for generating a first digital signal comprised of a sequence of pulses representative of respective actuated key switches in both of said first and second pluralities of key switches, the time length of said first digital signal being at least equal to the product of the number of key switches for one of said keyboards and the time required to scan one key switch; and third means coupled with said second means for supplying sound signals to a load, said sound signals being determined by the time positions of said pulses in said digital signal.

2. The combination according to claim 1 including at least fourth means coupled with said second means for supplying sound signals to a load, said sound signals supplied by said fourth means also being determined by the time positions of said pulses in said digital signal.

3. The combination according to claim 2 wherein said third and fourth means comprise first and second keyers, respectively.

4. The combination according to claim 1 including at least fourth means coupled with said first means for generating a second digital signal comprised of a sequence of pulses representative of respective actuated key switches in one of said first and second pluralities of key switches; and fifth means coupled with said fourth means for supplying sound signals to a load, said signals being determined by the time positions of said pulses in said second digital signal.

5. The combination according to claim 4 including sixth means coupled with said first means for generating a third digital signal comprised of a sequence of pulses representative of respective actuated key switches in the other of said first and second pluralities of key switches; and seventh means coupled with said sixth means for supplying sound signals to a load, said sound signals being determined by the time positions of said pulses in said third digital signal.

6. The combination according to claim 4 wherein the time positions of pulses in said sequences of pulses in said first and second digital signals representative of the same actuated key switches are aligned with one another;

said third and fifth means comprise first and second keyer circuits responsive to said first and second digital signals, respectively, for simultaneously supplying sound signals to the load or loads, said first keyer having capability for supplying a greater number of sound signals than said second keyer;

means responsive to each repetitive scan of said key switches for producing a strobe pulse; and means for supplying said strobe pulse to said first and second keyers for causing said keyers to produce said sound signals when the time positions of said pulses in said digital signals are in predetermined positions in said keyers, said strobe pulse being supplied to said second keyer at a predetermined time different from the application of said strobe pulse to the other of said keyers.

7. The combination according to claim 6 wherein said strobe pulse supplying means includes delay circuit means wherein said strobe pulse is applied to said delay circuit means and to said first keyer, said delay circuit means causing said strobe pulse to be delayed by a number of pulse positions of said digital signal proportional to the number of pulse positions by which the capability of said first keyer for supplying sound signals exceeds that of said second keyer.

8. In an electronic musical instrument having at least first and second pluralities of key switches for each of first and second keyboards, respectively, and at least one plurality of control switches, including in combination:

first means for scanning said control switches and said first and second pluralities of key switches repetitively and sequentially to detect actuation of any one or more key switches in each of said pluralities and to detect actuation of said control switches, such scanning of said first and second pluralities of key switches being simultaneous for said pluralities;

second means coupled with the output of said first means for generating a digital signal comprised of a serial sequence of pulses representative of sound signals determined by respectively actuated control switches and actuated key switches in both of said first and second pluralities of key switches; and third means coupled with said second means for supplying sound signals to a load, said sound signals being determined by the time positions of said pulses in said digital signal.

9. The combination according to claim 8 including at least fourth means coupled with said second means for supplying sound signals to a load, said sound signals supplied by said fourth means being determined by the time position of said pulses in said digital signal.

10. The combination according to claim 9 wherein said third and fourth means comprise first and second keyers, respectively, for supplying said sound signals to said loads.

11. The combination according to claim 10 wherein said first keyer is capable of producing a first predetermined number of sound signals and said second keyer is capable of producing a second predetermined number of sound signals less than said first predetermined number; and further including means coupled with said first means for aligning the operation of said first and second keyers in a predetermined manner relative to the sequence of pulses in said digital signal.

12. In an electronic musical instrument having at least first and second pluralities of key switches for each of first and second keyboards, respectively, and a first plurality of control switches, each of said first and second pluralities of key switches being arranged into groups of a predetermined number of key switches per group, each group corresponding to different octaves of keys on said first and second keyboards, respectively, and said control switches being arranged in groups of not more than said predetermined number of switches per group, said instrument including in combination:

means for connecting corresponding switches in each of said groups with corresponding common sense leads;

a plurality of drive leads each corresponding with a different group of key and control switches for sequentially enabling said groups of switches;

scanning means for sequentially sampling the respective sense leads for each different enabled group of key switches and control switches so that said key switches and control switches are scanned sequentially and repetitively to detect actuation of any one or more key switches and control switches in each of said pluralities of switches;

means coupled with said scanning means for combining the signals produced thereby to produce a first digital signal comprised of a sequence of pulses representative of sound signals determined by respective actuated key switches in both of said first and second pluralities of key switches and actuated control switches; and means responsive to said first digital signal for selecting corresponding sound signals to be controlled by said instrument.

13. The combination according to claim 12, further including a second plurality of control switches arranged in groups of not more than said predetermined number of switches per group, each of said first and second pluralities of control switches being interconnected with a different one of said first and second pluralities of key switches for scanning by said scanning means, key switches and control switches of corresponding groups of said first and second pluralities of key switches and control switches being simultaneously scanned by said scanning means.

14. The combination according to claim 13 further including additional means coupled with said scanning means for combining the signals produced by scanning said first plurality of key switches and said first plurality of control switches to produce a second digital signal comprised of a sequence of pulses representative of sound signals determined by respective actuated switches of said first pluralities of key and control switches; and further means coupled with said scanning means for combining the signals produced thereby in scanning said second plurality of key switches and said second plurality of control switches to produce a third digital signal comprised of a sequence of pulses representative of sound signals determined by respective actuated switches in said second pluralities of key and control switches; wherein said means responsive to said first digital signal also is responsive to said second and third digital signals for selectting corresponding tone signals to be reproduced by said instrument.

15. The combination according to claim 14 wherein said means responsive to said digital signals for selecting sound signals to be reproduced by said instrument comprises at least first, second and third keyer circuits each supplied with said first, second and third digital signals respectively.

16. The combination according to claim 15 further including means responsive to each repetitive scanning of said pluralities of switches for producing a strobe pulse; and means responsive to said strobe pulse for operating said first, second and third keyer circuits for responding to said first, second and third digital signals applied thereto to control sound signals determined by the time positions of the pulses in said digital signals at the time of application of said strobe pulse.

17. The combination according to claim 16 wherein at least one of said keyers has a capability for controlling a smaller number of sound signals than at least one other of said keyers, and further including means for delaying the strobe pulse applied to said at least one of said keyers by an amount selected to adjust for this different capability and to align the operation of said first, second and third keyers in a predetermined manner relative to the sequence of pulses in said first, second and third digital signals.

* * * * *